US011812811B2

(12) United States Patent
Baker et al.

(10) Patent No.: US 11,812,811 B2
(45) Date of Patent: Nov. 14, 2023

(54) ENERGY DIVERTING FOOTBALL HELMET

(71) Applicants: Michael Baker, Waldorf, MD (US); Leonard Samuel Baker, Scottsdale, AZ (US)

(72) Inventors: Michael Baker, Waldorf, MD (US); Leonard Samuel Baker, Scottsdale, AZ (US)

( * ) Notice: Subject to any disclaimer, the term of this patent is extended or adjusted under 35 U.S.C. 154(b) by 0 days.

(21) Appl. No.: 17/300,563

(22) Filed: Aug. 20, 2021

(65) Prior Publication Data

US 2022/0053866 A1 Feb. 24, 2022

Related U.S. Application Data

(63) Continuation-in-part of application No. 16/602,597, filed on Nov. 7, 2019, now abandoned.

(60) Provisional application No. 62/917,127, filed on Nov. 23, 2018.

(51) Int. Cl.

| | |
|---|---|
| ***A42B 3/06*** | (2006.01) |
| ***A42B 3/20*** | (2006.01) |
| ***A42B 3/08*** | (2006.01) |

(52) U.S. Cl.

CPC ..... *A42B 3/064* (2013.01); *A42B 3/08* (2013.01); *A42B 3/20* (2013.01)

(58) Field of Classification Search

CPC ..... A42B 3/062; A42B 3/063; A42B 3/064; A42B 3/065; A42B 3/06; A42B 3/069; A42B 3/066; F16F 7/10

USPC ..... 2/411, 412, 414, 416, 425

See application file for complete search history.

(56) References Cited

U.S. PATENT DOCUMENTS

| | | | | |
|---|---|---|---|---|
| 5,713,082 | A * | 2/1998 | Bassette | A42B 3/061 2/412 |
| 2002/0017805 | A1* | 2/2002 | Carroll, III | B32B 27/304 188/371 |
| 2006/0070170 | A1* | 4/2006 | Copeland | A63B 71/10 2/412 |
| 2006/0191403 | A1* | 8/2006 | Hawkins | A42B 3/064 89/36.05 |
| 2008/0256686 | A1* | 10/2008 | Ferrara | A63B 71/0054 2/413 |
| 2011/0203038 | A1* | 8/2011 | Jones, Jr. | A42C 2/007 264/442 |
| 2014/0196198 | A1* | 7/2014 | Cohen | A42B 3/063 2/414 |
| 2016/0021965 | A1* | 1/2016 | Mayerovitch | A42B 3/064 2/414 |
| 2016/0327113 | A1* | 11/2016 | Shelley | B32B 3/30 |
| 2017/0295880 | A1* | 10/2017 | Kennedy | A42B 3/064 |
| 2017/0303623 | A1* | 10/2017 | Sicking | A42B 3/064 |

(Continued)

*Primary Examiner* — Aiying Zhao
(74) *Attorney, Agent, or Firm* — GRANT PATENT SERVICES; Jonathane Grant

(57) ABSTRACT

An energy diverting football helmet is disclosed. The helmet contains the shell having an inside and an outside, padding positioned against the inside of the shell. There is also a face mask attached to the front of the football helmet, and a chin strap. On the outside of the shell there is a plurality of flexible energy divergent baffles (FEDB) attached to the outside of said shell. The flexible energy divergent baffle comprises a base, a flat top, and an offset baffle connecting the flat top with the base. On top of the base is a wafer, upon which resides an energy transferring bumper.

22 Claims, 23 Drawing Sheets

(56) References Cited

U.S. PATENT DOCUMENTS

2018/0042329 A1* 2/2018 Grice ..... A42B 3/06

* cited by examiner

IMPACT SITE F

IMPACT SITE C

IMPACT SITE D

IMPACT SITE A'

IMPACT SITE B

NOCSAE TESTING (AMBIENT CONDITIONED IMPACTS)

| HELMET MODEL | AVERAGE SEVERITY INDEX (SI) | % IMPROVEMENT |
|---|---|---|
| BAKER 1.5 | 201.8 | 16% |
| BAKER 2.0 | 179.58 | 26% |
| FTE-CONT | 241.44 | |

| HELMET MODEL | AVERAGE ACCELERATION | % IMPROVEMENT |
|---|---|---|
| BAKER 1.5 | 55.55 | 77% |
| BAKER 2.0 | 54.83 | 77% |
| FTE-CONT | 74.83 | |

FORWARD THINKING ENTERPRISES PROPRIETARY INFORMATION

FIG. 22

NOCSAE TESTING HOT CONDITIONED IMPACTS)

| HELMET MODEL | AVERAGE SEVERITY INDEX (SI) | % IMPROVEMENT |
|---|---|---|
| BAKER 1.5 | 307.88 | 45% |
| BAKER 2.0 | 318 | 43% |
| FTE-CONT | 558.38 | |

| HELMET MODEL | AVERAGE ACCELERATION | % IMPROVEMENT |
|---|---|---|
| BAKER 1.5 | 79.31 | 86% |
| BAKER 2.0 | 76.98 | 86% |
| FTE-CONT | 132.91 | |

FORWARD THINKING ENTERPRISES PROPRIETARY INFORMATION

FIG. 23

NFLPA TESTING - LINEAR ACCELERATION

| | BAKER 1.5 | | BAKER 2.0 | | FTE-CONT |
|---|---|---|---|---|---|
| IMPACT SITE | PEAK LINEAR ACCEL (G) | % IMPROVEMENT | PEAK LINEAR ACCEL (G) | % IMPROVEMENT | PEAK LINEAR ACCEL (G) |
| A | 61.9 | 7.0% | 58.5 | 12.1% | 66.5 |
| A' | 40.0 | 39.9% | 37.9 | 43.0% | 45.0 |
| B | 62.8 | 5.6% | 56.4 | 15.3% | 60.0 |
| C | 51.9 | 22.1% | 39.6 | 40.5% | 76.1 |
| D | 36.8 | 44.6% | 32.1 | 51.8% | 65.0 |
| F | 38 | 42.9% | 36.1 | 45.8% | 77.1 |
| R | 52.8 | 20.7% | 51.3 | 22.9% | 77.5 |
| UT' | 53.0 | 20.4% | 55.3 | 16.9% | 71.0 |

FORWARD THINKING ENTERPRISES PROPRIETARY INFORMATION

FIG. 24

NFLPA TESTING - HIC15

| | BAKER 1.5 | | BAKER 2.0 | | FTE-CONT |
|---|---|---|---|---|---|
| IMPACT SITE | HIC15 | % IMPROVEMENT | HIC15 | % IMPROVEMENT | HIC15 |
| A | 62.3 | 17.0% | 60.5 | 19.4% | 75.1 |
| A' | 29.4 | 60.9% | 29.7 | 60.4% | 59.3 |
| B | 56.7 | 24.4% | 38.0 | 49.4% | 88.1 |
| C | 26.8 | 64.3% | 15.2 | 79.7% | 128.7 |
| D | 32.8 | 56.4% | 23.4 | 68.8% | 79.2 |
| F | 23.4 | 68.9% | 25.4 | 66.2% | 137.7 |
| R | 54.6 | 27.2% | 52.1 | 30.7% | 133.3 |
| UT' | 25.4 | 66.2% | 21.2 | 71.7% | 62.8 |

FORWARD THINKING ENTERPRISES PROPRIETARY INFORMATION

FIG. 25

NFLPA TESTING - SEVERITY INDEX (SI)

| | BAKER 1.5 | | BAKER 2.0 | | FTE-CONT |
|---|---|---|---|---|---|
| IMPACT SITE | SI | % IMPROVEMENT | SI | % IMPROVEMENT | SI |
| A | 159.6 | 7 1% | 136.1 | 20.8% | 171.9 |
| A' | 62.9 | 63.4% | 59.3 | 65.5% | 100.3 |
| B | 140.0 | 18.5% | 101.8 | 40.8% | 183.3 |
| C | 72.7 | 57.7% | 37.7 | 78.1% | 307.1 |
| D | 56.2 | 67.3% | 37.6 | 78.1% | 195.4 |
| F | 46.9 | 72.7% | 47.3 | 72.5% | 327.1 |
| R | 118.1 | 31.3% | 114.4 | 33.4% | 366.7 |
| UT' | 78.3 | 54.4% | 74.4 | 56.7% | 175.6 |

FORWARD THINKING ENTERPRISES PROPRIETARY INFORMATION

FIG. 26

ENERGY DIVERTING FOOTBALL HELMET

This application claims priority to continuation-in-part of application Ser. No. 16/602,597, filed Nov. 7, 2019, which claims priority to U.S. Provisional Application No. 62/917,127 filed Nov. 23, 2018, all incorporated herein by reference.

A helmet is disclosed which diverts and absorbs the energy of an impact.

BRIEF DESCRIPTION OF THE DRAWINGS

FIG. 22 is a chart showing the comparisons of the protection offered by the helmets taught in the disclosure compared to a standard helmet under ambient conditioned impacts;

FIG. 23 is a chart showing the comparisons of the protection offered by the helmets taught in the disclosure compared to a standard helmet under hot conditioned impacts;

FIG. 24 is a chart showing the results of linear acceleration testing of the helmets;

FIG. 25 is a chart showing the results of HIC15 testing of the helmets; and

FIG. 26 is a chart showing the results of Severity Index testing of the helmets.

Figure 1:
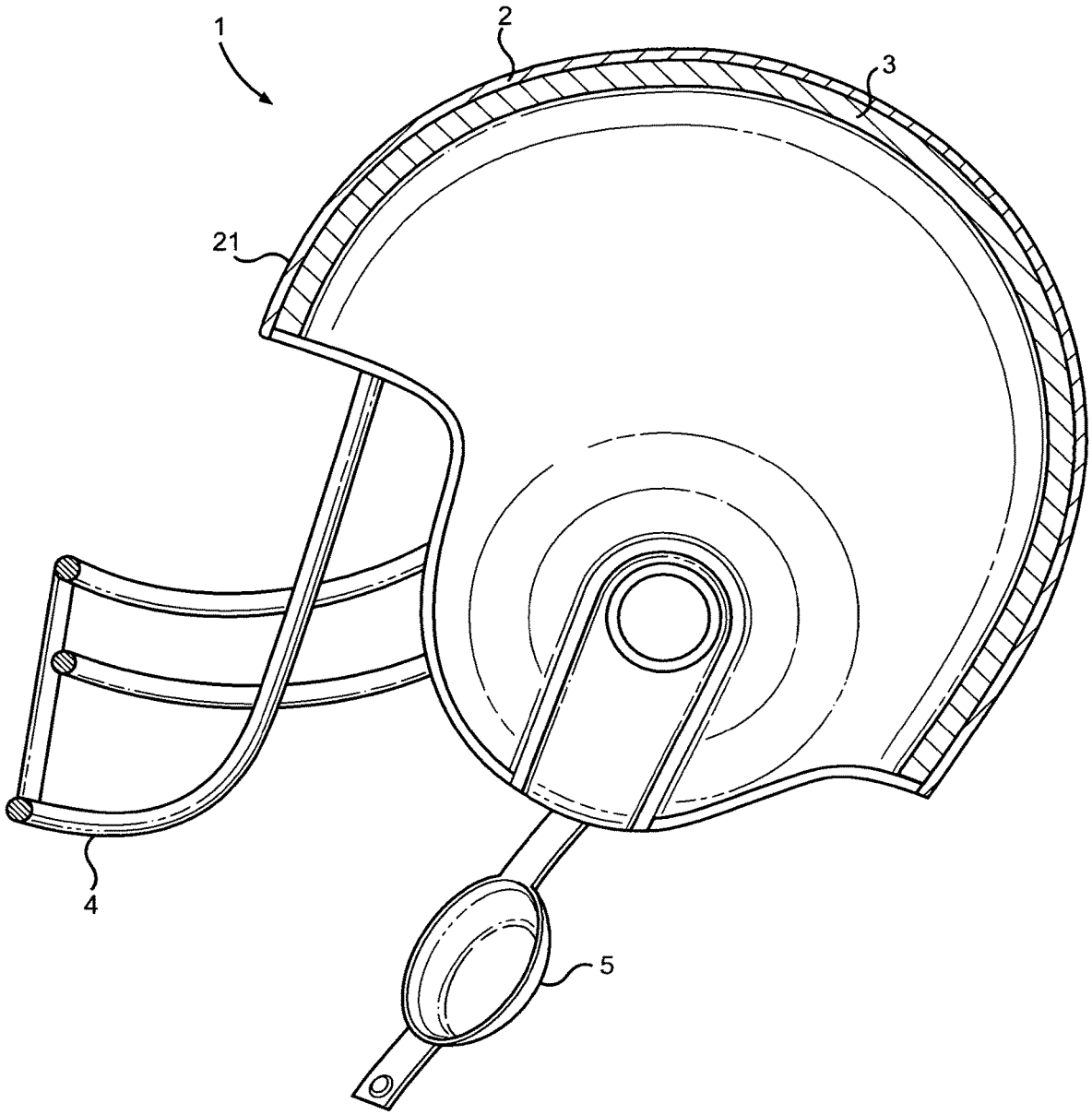
FIG. 1 is a cross section of a football helmet.
Figure 2B:
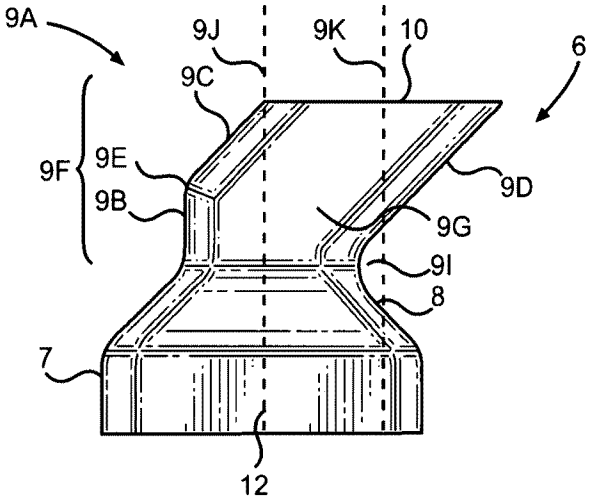
FIG. 2B is a side view of the flexible energy divergent baffle.
Figure 4:
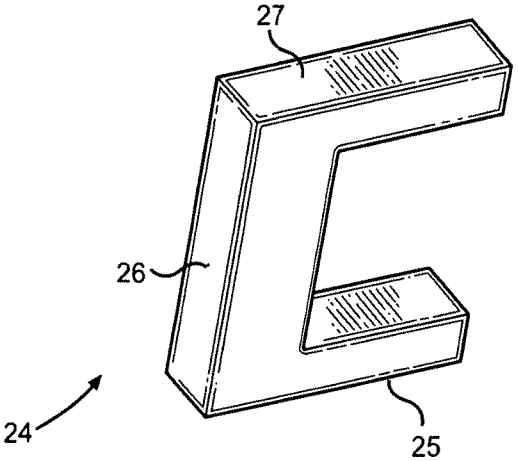
FIG. 4 is a perspective view of one embodiment of the flexible energy divergent baffles on the football helmet.
Figure 2A:
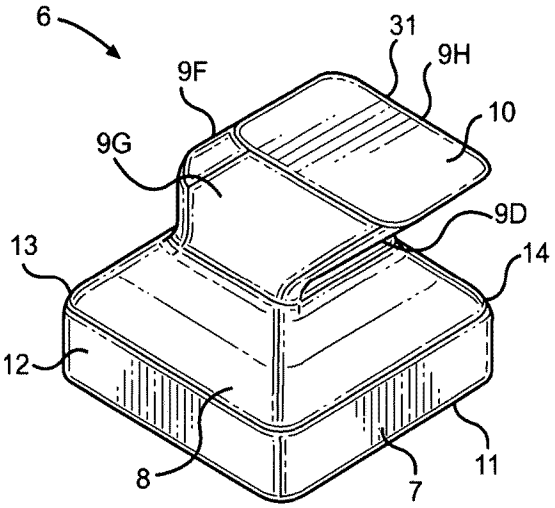
FIG. 2A is a perspective of a flexible energy divergent baffle.
Figure 3:
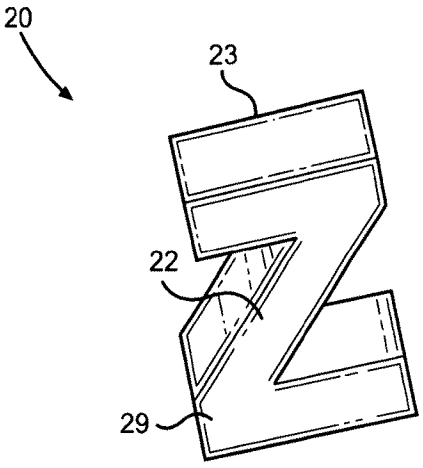
FIG. 3 is a perspective view of another embodiment of the flexible energy divergent baffle.

The figures depict various embodiments of the described methods and kit and are for purposes of illustration only. One skilled in the art will readily recognize from the following discussion that alternative embodiments of the methods and kits illustrated herein may be employed without departing from the principles of the methods and kits described herein.

DETAILED DESCRIPTION OF THE EMBODIMENT

The football helmet 1 disclosed herein is designed to better protect the wearer from a head injury. More specifically, the football helmet 1 is designed to reduce the risk of head and brain injuries during the playing of the game. The embodiments taught can be used for other helmets, including safety (construction) helmets.

The typical football helmet 1 is made of a hard plastic. More specifically, the football helmet is a hard shell 2 with thick padding 3 on the inside and underneath the hard shell 2, a face mask 4 made of one or more plastic-coated metal bars, and a chinstrap 5 The plastic shell 2 is normally made out of polycarbonate and can have a duro rating greater than about 100.

The durometers are measured using the Shore A scale.

Figure 6:
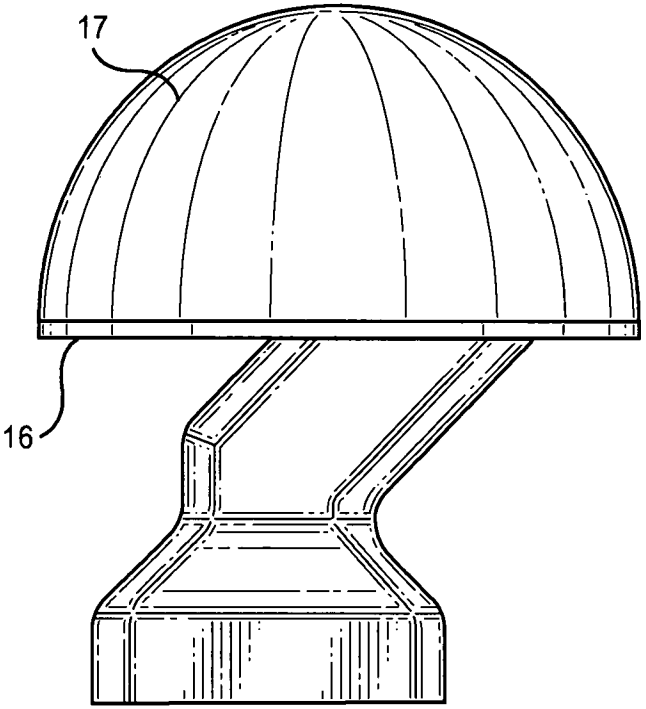
FIG. 6 is a side view of a flexible energy divergent baffle with a wafer positioned on top of the flexible energy divergent baffle and a bumper positioned on top of the wafer.
Figure 5:
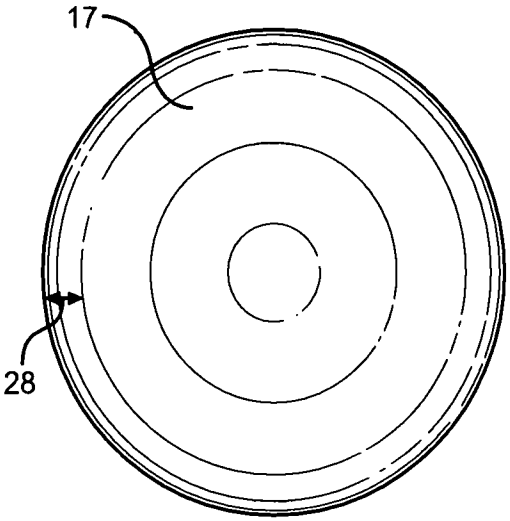
FIG. 5 is a top view of a bumper.
Figure 7:
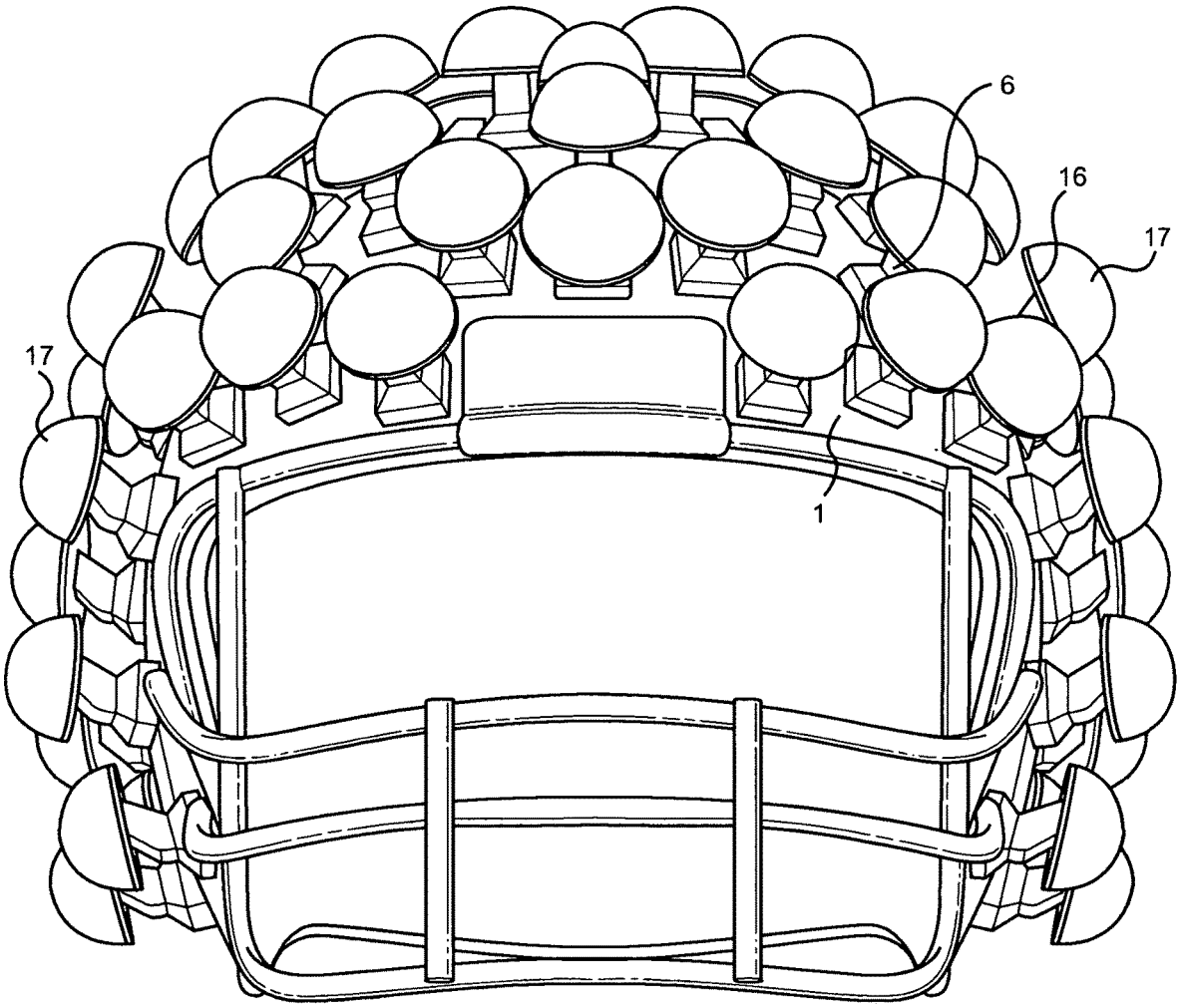
FIG. 7 is a side view of a flexible energy divergent baffle with a wafer position on top and a bumper positioned on top of the wafer.
Figure 8:
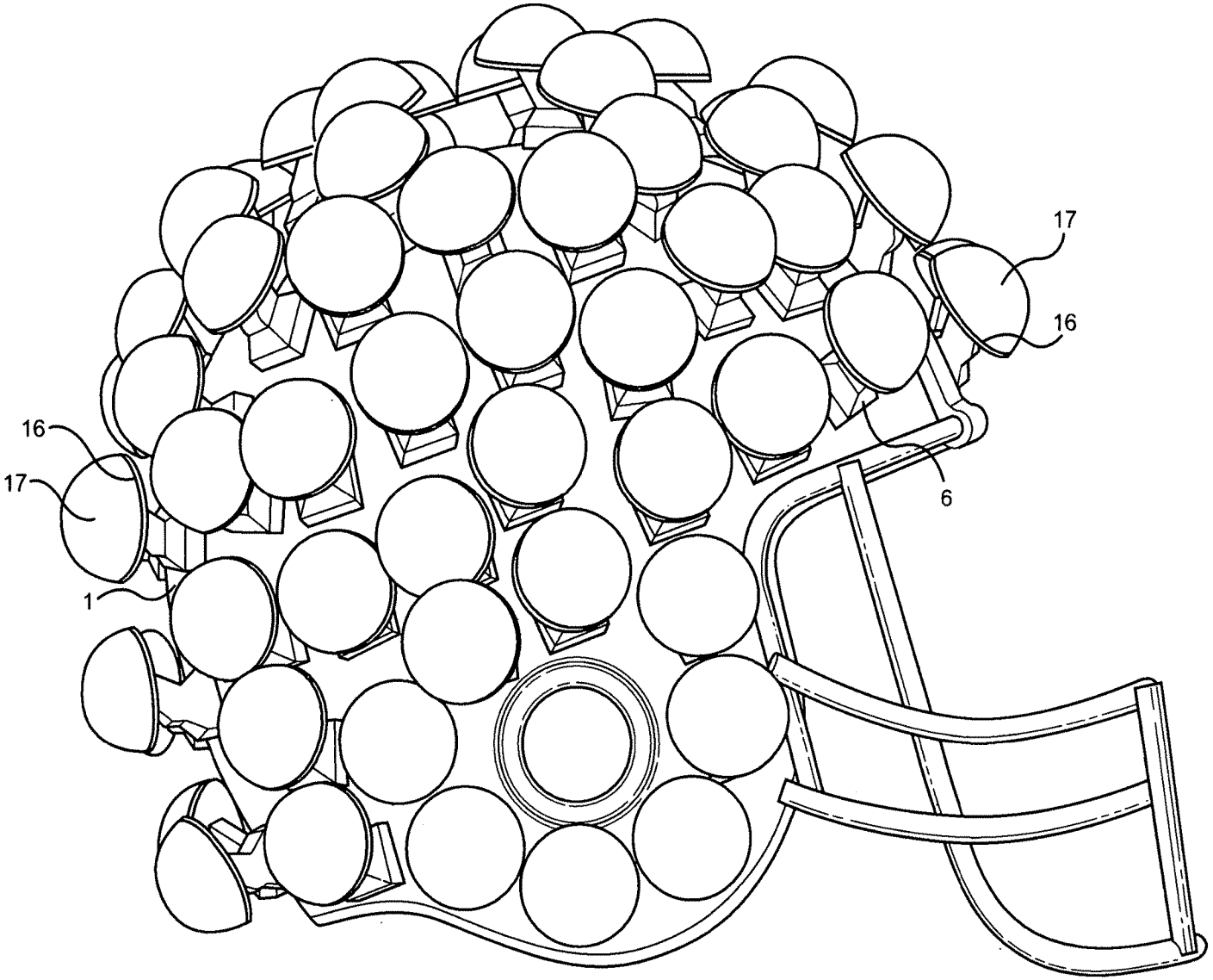
FIG. 8 is a front view of bumper assemblies covering the helmet.
Figure 9:
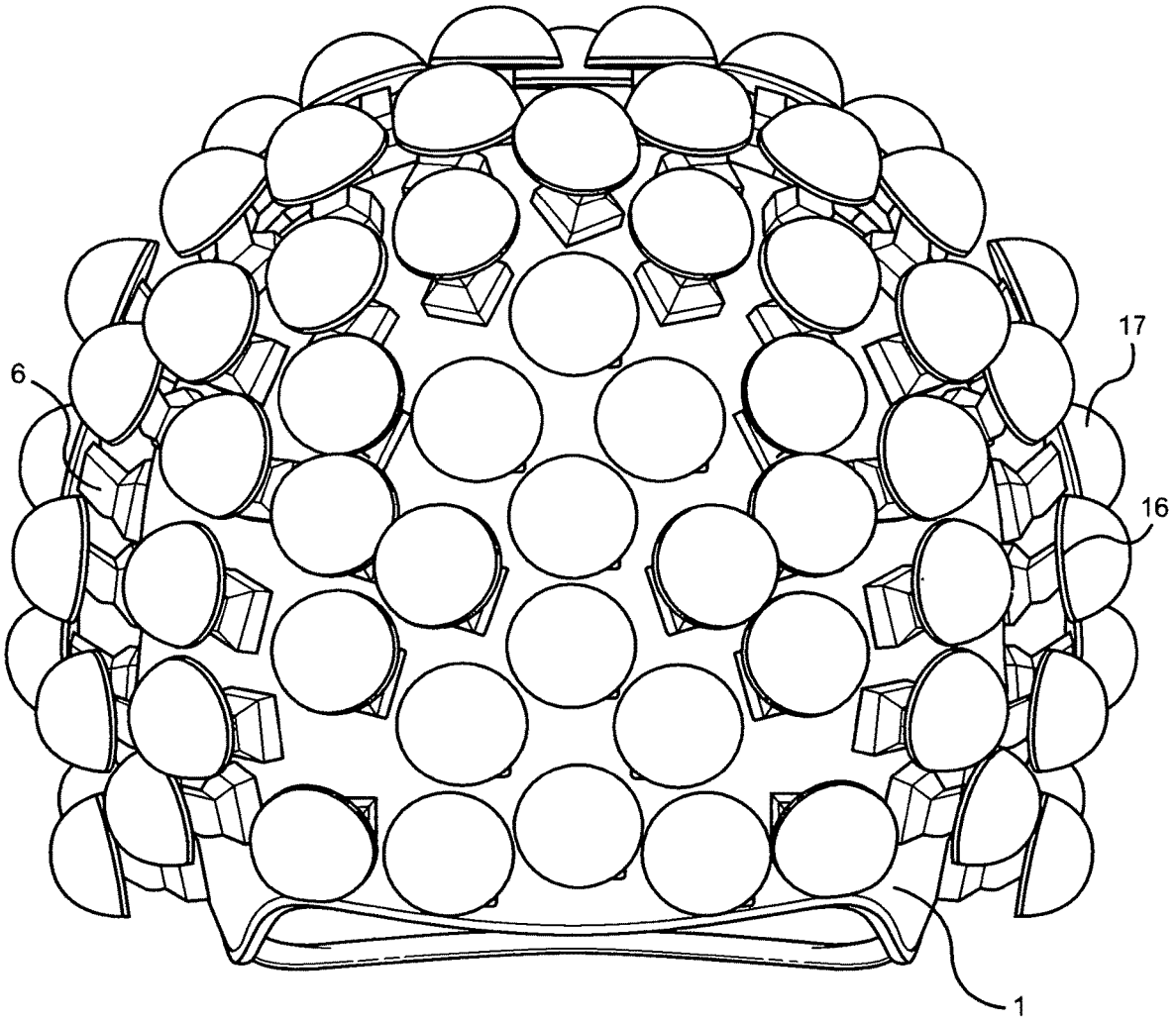
FIG. 9 is the right side view of the bumper assemblies covering the helmet.
Figure 10:
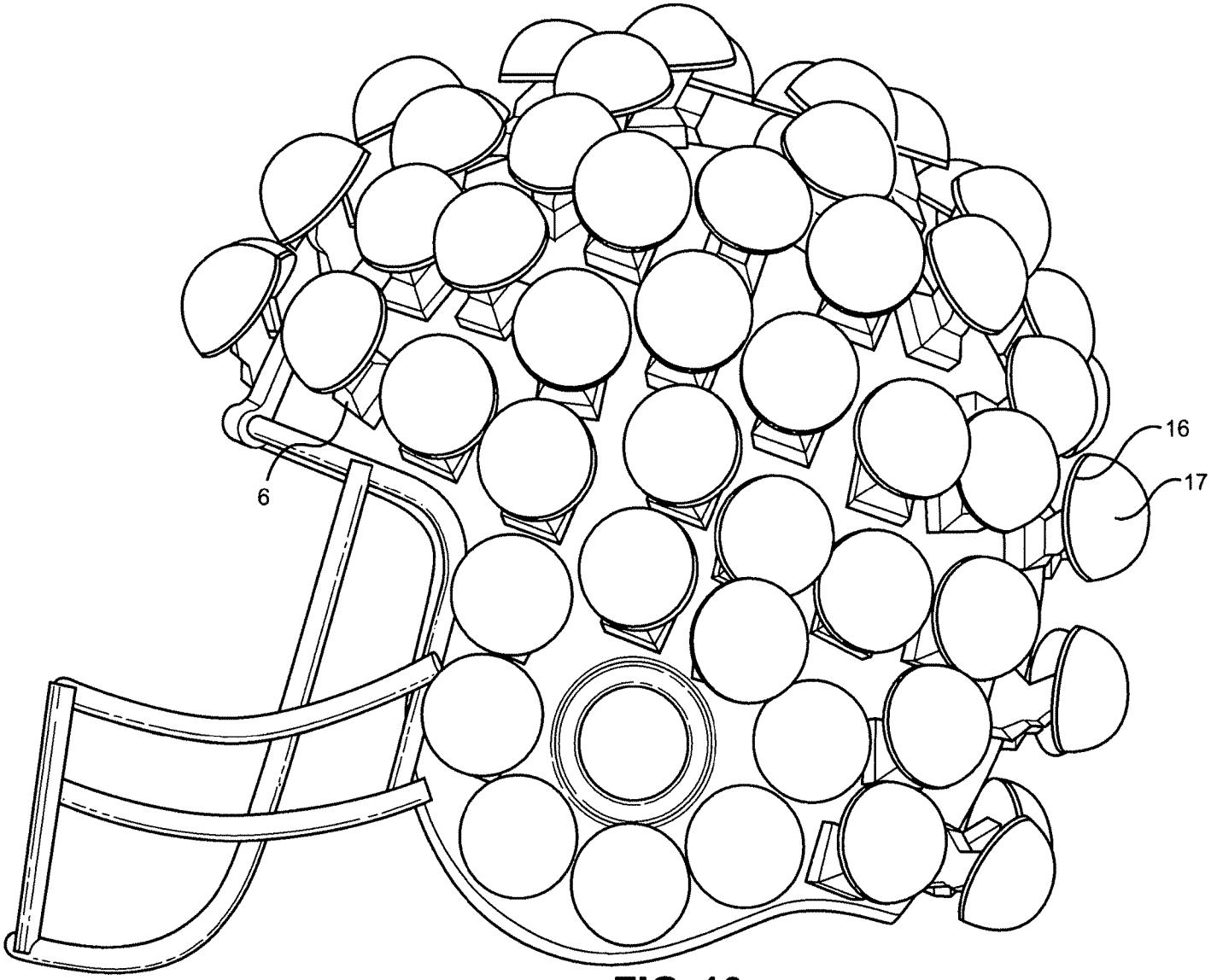
FIG. 10 is a back view of the bumper assemblies covering the helmet.
Figure 11:
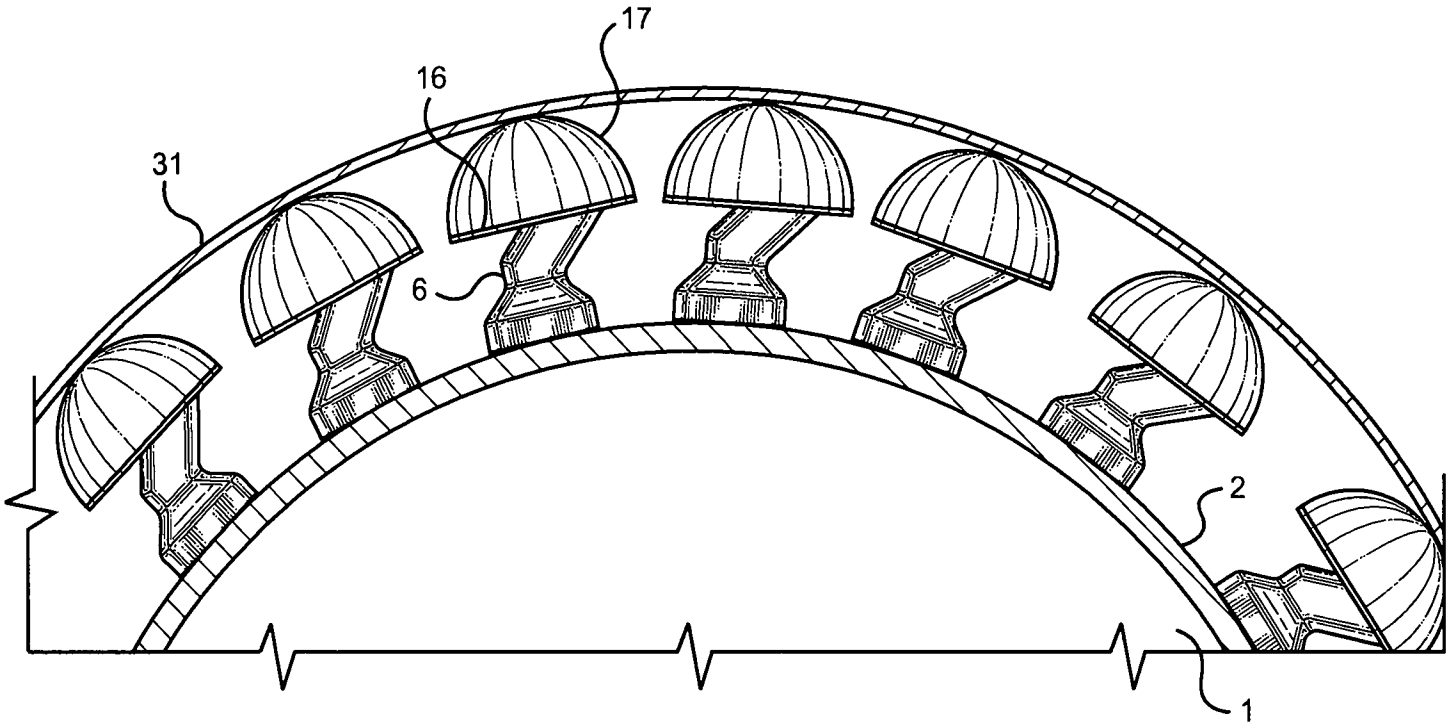
FIG. 11 is a left side view of the bumper assemblies covering the helmet.

In one embodiment of the present disclosure, a plurality of flexible energy baffels (FEDS) as depicted in FIG. 6 are attached to the outer surface of the shell 2 of the helmet as depicted in FIG. 1. The energy divergent baffles 6 each comprise a base 7, a foot or support 9A, and an off center flat top 10 positioned and integral with said foot or support 9A.

In one embodiment, a rectangular or square flat top 10 is positioned on top of an upturned foot 9A, which is-positioned on top of a flat topped pyramidal platform 8 positioned on top and integral with the square base 7 with the off center flat top 10 extending beyond where the edge 9I of the top of the flat topped pyramidal platform 8 meets a first side of the foot, which is angled away from the base. This gives the FEDB 6 enough balance. Similarly, the flat top can be of any shape as long as it is flat.

In one embodiment the foot 9A has a first side 9D angled away from the pyramid 8 or from a base 7, first side 9D from base 7. A second side 9F from the pyramid 8 or from a first side, the second side comprising a vertical rise 9B, on top of which is an angled short side 9C at intersecting point or hinge point 9E. The vertical rise 9B is about ¼ to ½ the height of the second side 9F. In another embodiment, the vertical rise 9B is up to about 40% of the height of second side 9F In one embodiment, the angles of sides 9C and 9D are identical. In another embodiment, both angles are in the same angular direction. Consequently, the center point of flat top 10 is offset or off centered from the center point of base 7. Walls 9G and 9H connect walls 9D and 9F at their edges. In another embodiment, there is a curve 9I at the joinder between the platform and wall 9D to allow for easier bending and less stress on the rubber. Also included are dotted lines showing the center points of the base 7 and 12 and the flat top 10 and 9K illustrating how the top of the FEDB is offset from the bottom.

The height of the FEDB 6 can range from about a ¼" high to about 1" high. These ranges are not limited and the FEDB 6 can be larger or smaller than indicated. To give some perspective, the 1" high FED 6 has a base measuring about 1" by about 1" and the flat top is about ⅞" long and about ½" wide. It should be noted that the base of the FEDB 6 can range up to about 2" or more, if so desired, and the flat top can be proportionately larger as well. These numbers may also vary. The FEDB 6 have a duro value in one embodiment of no greater than about 35 to about 40. The duro can be as lower or lower than about 30. In yet another embodiment, the duro can be between about 40 to about 50. In one embodiment, the FEDB 6 are made out of a flexible rubber such that they can angularly bend when an item strikes them. In another embodiment, the FEDB 6 is made out of plastic or silicone or any other material that allows for the traits described therein. It should also be noted that the material used should have memory.

In another embodiment, the FEDB can be in the general shape of a "Z" 20. The base 29 of the "Z" 20 is attached to the outer surface 21 of the shell 2 of the helmet 1. A thickened diagonal section 22 supports a flat top 23. In yet another embodiment, the FEDB can be in the shape of a staple 24. The staple shaped FEDB 24 has a base 25, a vertical support 26, and a flat top 27. For clarity purposes, the proximal end of the of the vertical support 26 is positioned at one end of the base, and the distal end of the vertical support 26 is attached to the flat top 27. The parts of the FEDB are integrally attached, and in one embodiment are molded in one piece.

Fundamentally, in another embodiment, the FEDB can be of any shape, as long as the flat top is off center from a vertical support 26.

The FEDB 6 is secured to the outside of the football shell 2. Any method can be used to secure the FEDB 6 to the outside of the football shell 2, including the use of rubber cement, rubber paint, and mixtures thereof, as well as other types of glues. There may also be other means of attachment known in the art, including small screws. In one embodiment, the FEDB 6 cover the entire outer surface of the shell 2. When the FEDB are about one inch tall, it takes about 70 FEDBs to cover the entire outer surface of the shell 2.

It should be noted that the FEDB 6 can be solid, or it can be hollow. A hollow FEDB 6 will lighten the weight of the helmet.

On the top of the off-center/offset flat top 10 of each of the FEDB 6 is rigid flat wafer 16. In one embodiment, the wafer 16 is made out of carbonate, of which football helmets are usually made In other embodiments, the wafer 16 is made out of aluminum, a steel alloy, any metals or metal alloys stronger or lighter than steel, and any plastics stronger and lighter than steel. The wafer can also be made out of Kevlar. Depending on the material used, the width of the wafer 16 can range from about 1/16" to about ¼". In one embodiment, the wafer has the same outer dimensions as the perimeter of the flat top 10. In another embodiment, the wafer 16 extends beyond the perimeter of the flat top 10. The amount of overlap of the wafer 16 on the flat top 10 may vary.

On top of the wafer 16 is attached a bumper 17. In one embodiment, the wafer 16 is first attached to the bumper 17 before being attached to the flat top 10 of the FEDB 6. In another embodiment, the wafer is first attached to the to the flat top 10 before the bumper 17 is attached. In yet another embodiment, everything is assembled before the FEDB 6 is attached to the shell.

The bumper 17 has a duro hardness ranging from about 70 to about 100 duro. The bumper 17 is in the shape of a semicircle or more correctly, is in the shape of half of a hollow ball, and is made out of either rubber or plastic. While the phrase "half a hollow ball" is used, the shape is somewhat more or less than half a hollow ball, such that there can be a ball that was cut on about the 30% mark to about the 60% mark. The outside width of the bumper can range in size from 1" to about 2" with some sizes smaller or larger. In one embodiment, the outside width of the bumper is about 1.5 inches. In another embodiment, the outside width of the bumper is two inches. Where the outside width of the of the bumper is at least 1" to about 2", the width of the rubber or plastic is about ¼". The bumper 17 is attached to the wafer 16 by any effective means known in the art, including rubber glue or any other effective glue. In one embodiment, the bumper 17 is larger than the wafer 16, and yet in another embodiment, the bumper 17 is smaller than the wafer 16. Given that the bumper 17 is round, some parts of the bumper may extend beyond the wafer 16. In another embodiment, the shape and width of the base 36 is about equivalent to the width and shape of the wafer 16. It should also be noted that the duro hardness of the bumper 17 may fall outside of the range given, and may be softer or harder than indicated.

The bumpers 17, and the FEDBs 6 can be made out of rubber, plastic, or other materials that have elasticity. The wafer 16 can be made out of rubber, plastic, metal or other materials.

In yet another embodiment, the bumper 17 resides directly on top of the FED 6, without the need of a wafer 16 interface.

In football, when a player is hit in the head, the impact can be in excess of 150 g forces. When the wearer of the present helmet is hit in the head, instead of the energy being directly transmitted to the player's head, thereby risking a concussion, the bumpers 17 absorb and transfer the energy angularly away from the point of impact. The FEDBs 6 further absorb and transfer the energy angularly away from the point of impact. This lessens the risk of concussion as the inertia energy is dispersed and distributed away from the point of impact. Much of the energy is spent by the movement of the bumper and the FEDB 6, while much of the impact energy is distributed over the entire helmet.

Other embodiments can further lessen the effects of an impact. In embodiment, the shell 2 of the football helmet 1 is made of a material giving the shell a hardness rating less than about 100. In another embodiment, this shell 2 could be soft enough so as to indent upon impact. In one embodiment, this soft shell 2 is made of a soft plastic or a rubber having a duro at or under about 80 duros, and in one embodiment in about the 70 to about 80 duro range. In yet another embodiment, the duro range of the shell 2 can be in the about 30 to about 80 range, and in yet another embodiment the shell 2 has a range of from about 30 to about 50. In yet n another embodiment, only selected parts of the shell 2 have a selected duro in the range of about 30-50, in order to reduce impact-force transfer to the athlete's head. In another embodiment, flex is engineered into the helmet's shell, facemask, and attachment system.

In one of the embodiments, the largest section of helmet padding is stiff polypropylene foam that nearly covers the entire internal surface of the helmet. Its main role is to absorb impacts and provide general protection. In another embodiment, the helmet padding is a gel pad. In another embodiment, the helmet pad is water filled pad. This further allows for energy absorption from an impact. In another embodiment EVA foam, a closed cell foam made from ethylene Vinyl Acetate and blended co-polymers is used for the inner pad.

In yet another embodiment, the seat of the chin strap, or the part where the chin fits, has a gel cushion insert.

Figure 12:
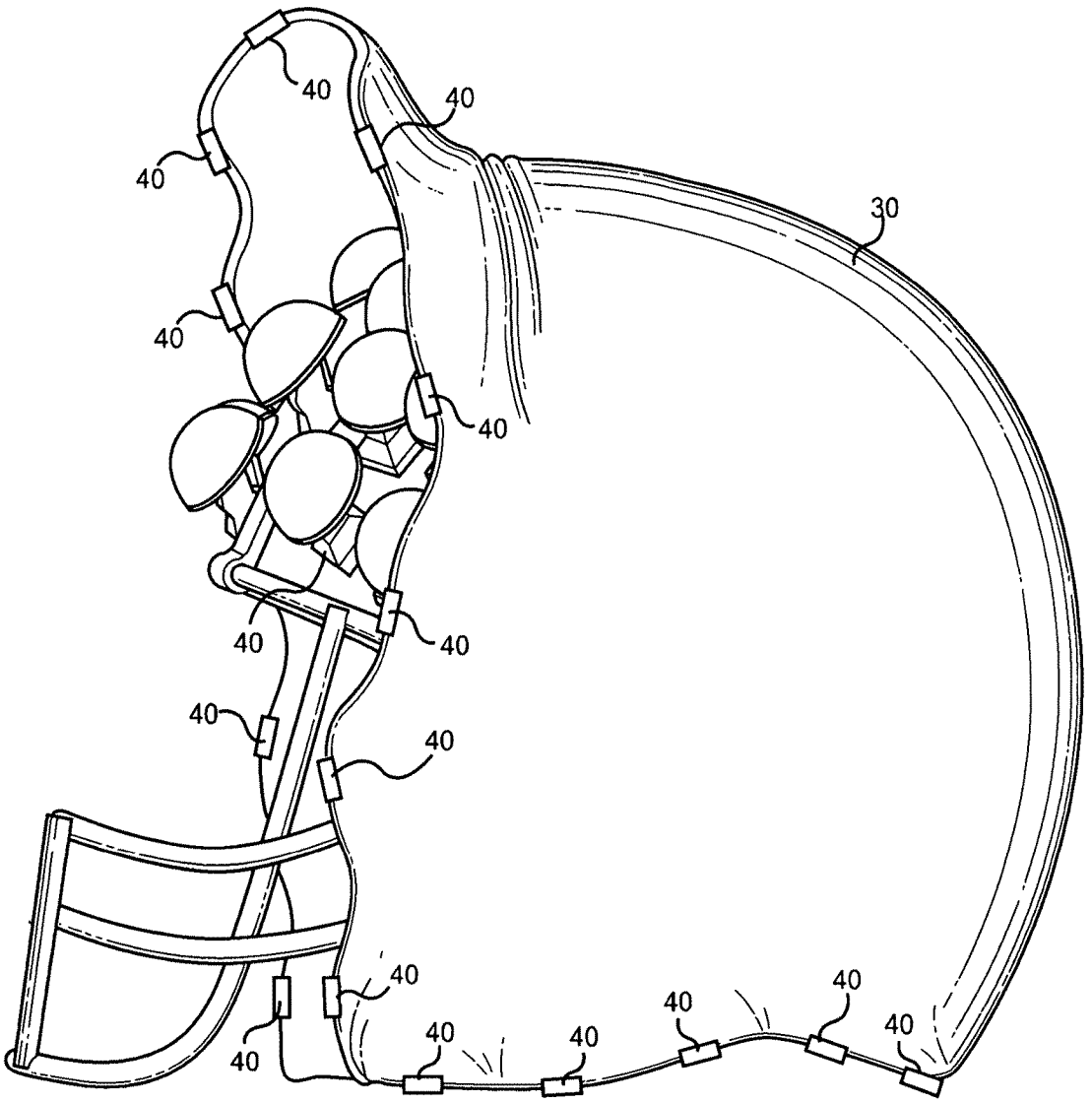
FIG. 12 is a cross view of an outer soft covering over the bumper assemblies on the helmet.
Figure 13A:
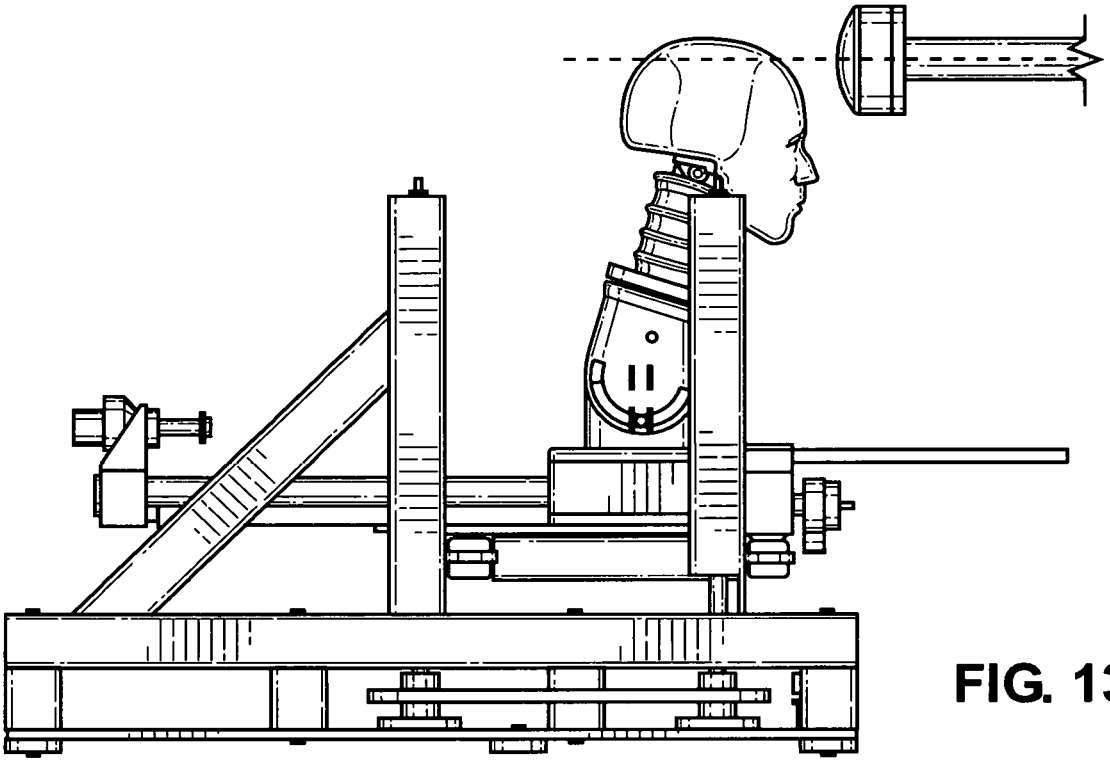
FIG. 13A is a side view showing the head position and orientation for impact site F.
Figure 13B:
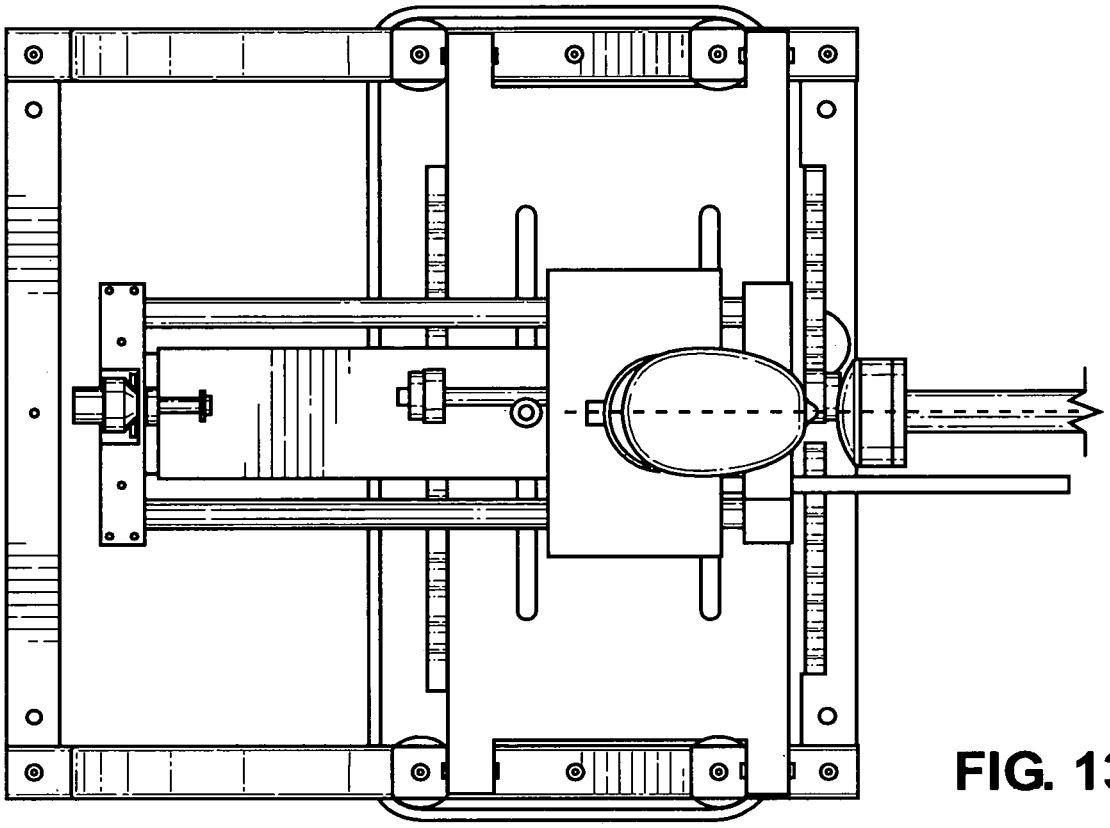
FIG. 13B is an overhead view showing the head position and orientation for impact site F.
Figure 14A:
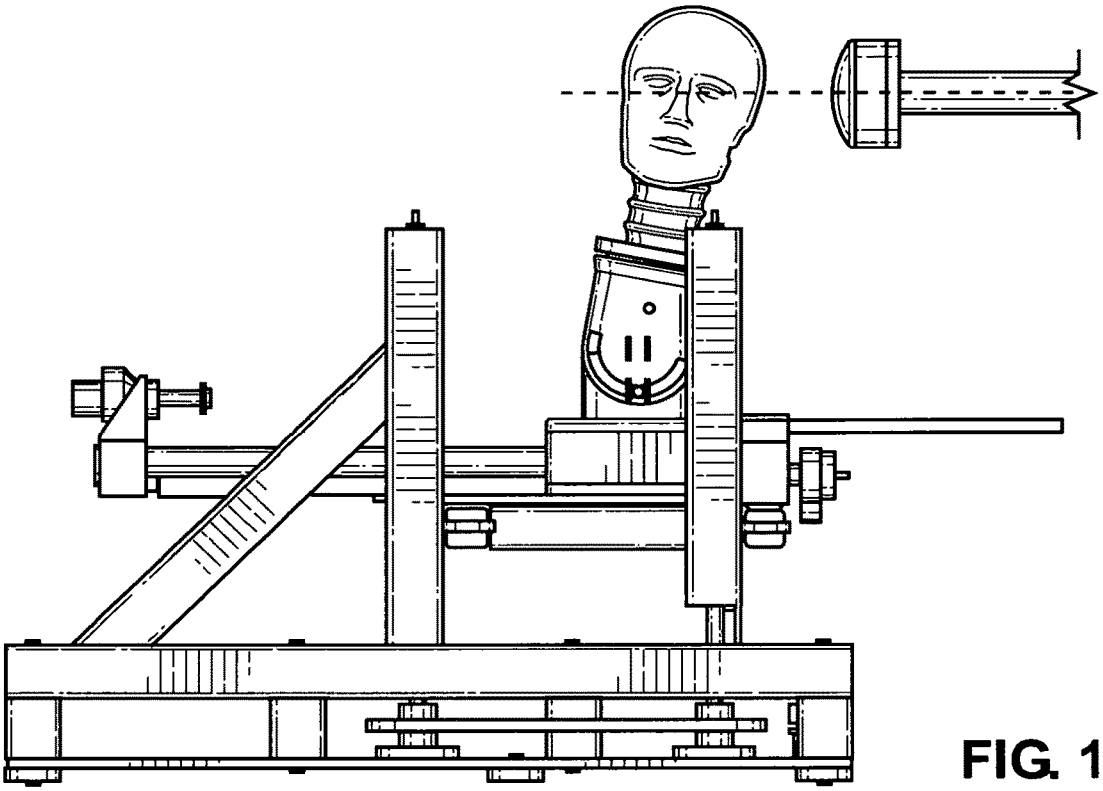
FIG. 14A is a side view showing the head position and orientation for impact site C.
Figure 14B:
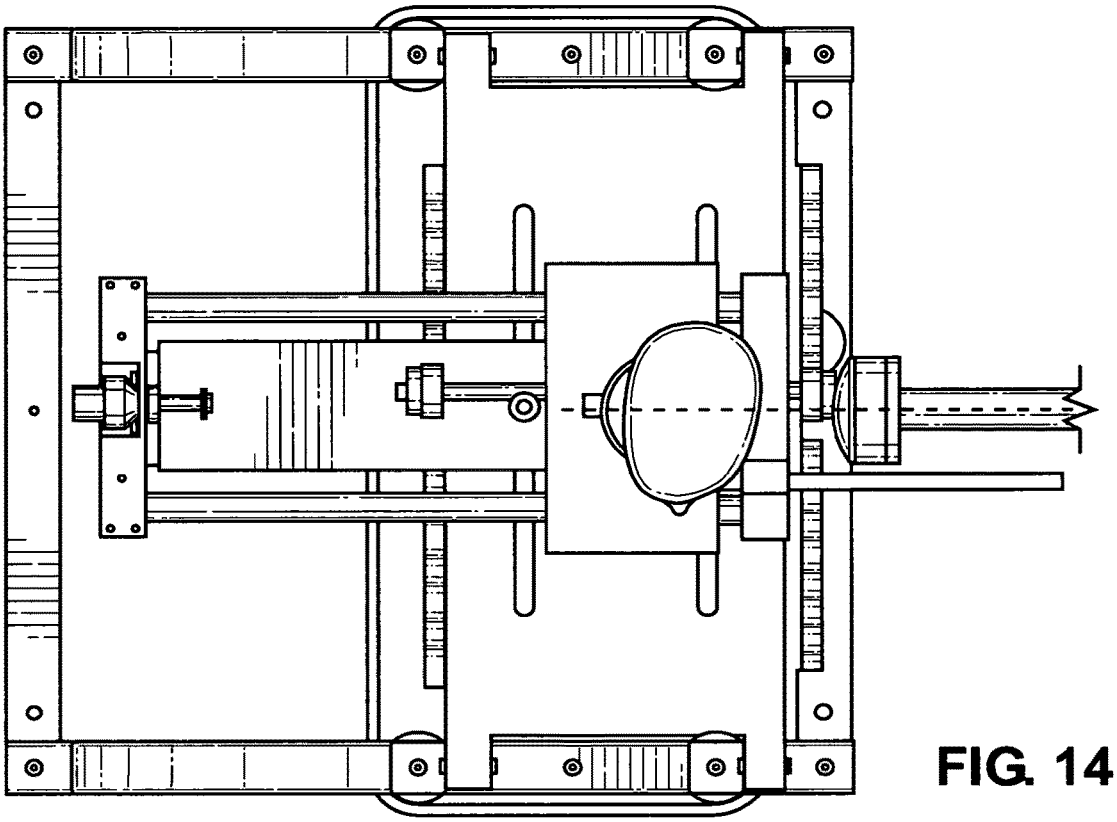
FIG. 14B is an overhead view showing the head position and orientation for impact site C.
Figure 15A:
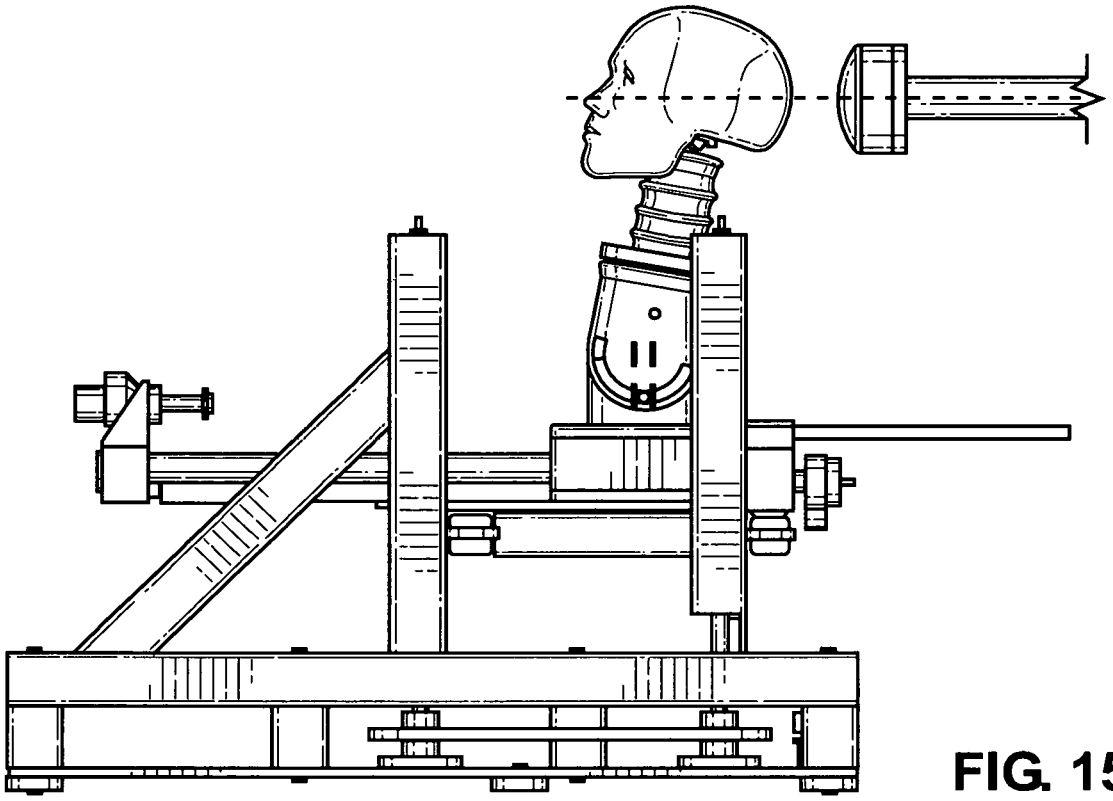
FIG. 15A is a side view showing the head position and orientation for impact site D.
Figure 15B:
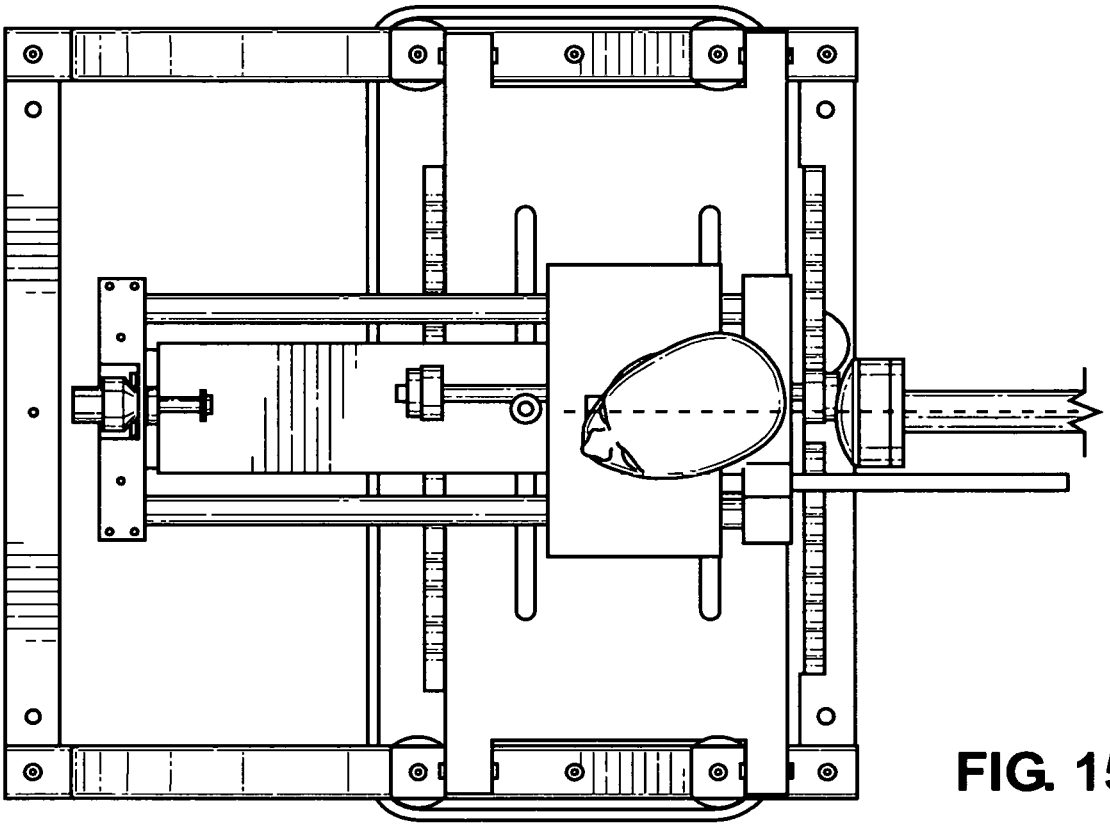
FIG. 15B is an overhead view showing the head position and orientation for impact site D.
Figure 16A:
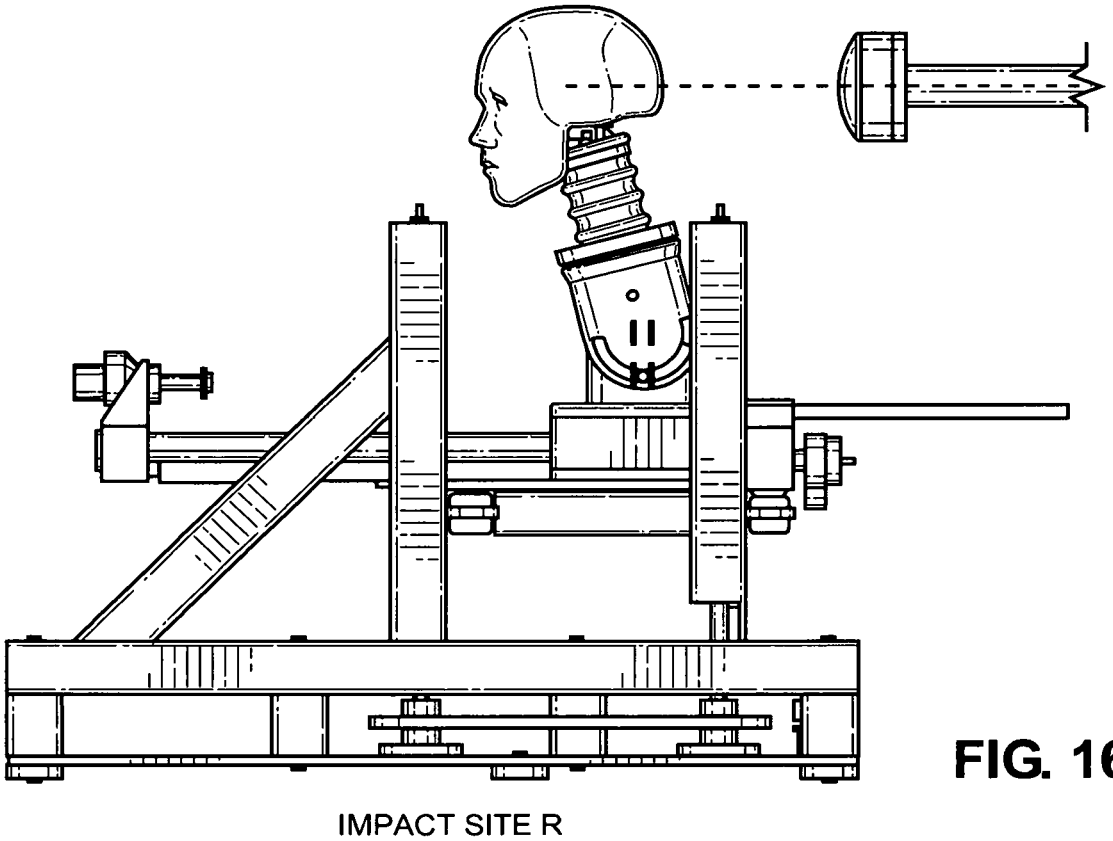
FIG. 16A is a side view showing the head position and orientation for impact site R.
Figure 16B:
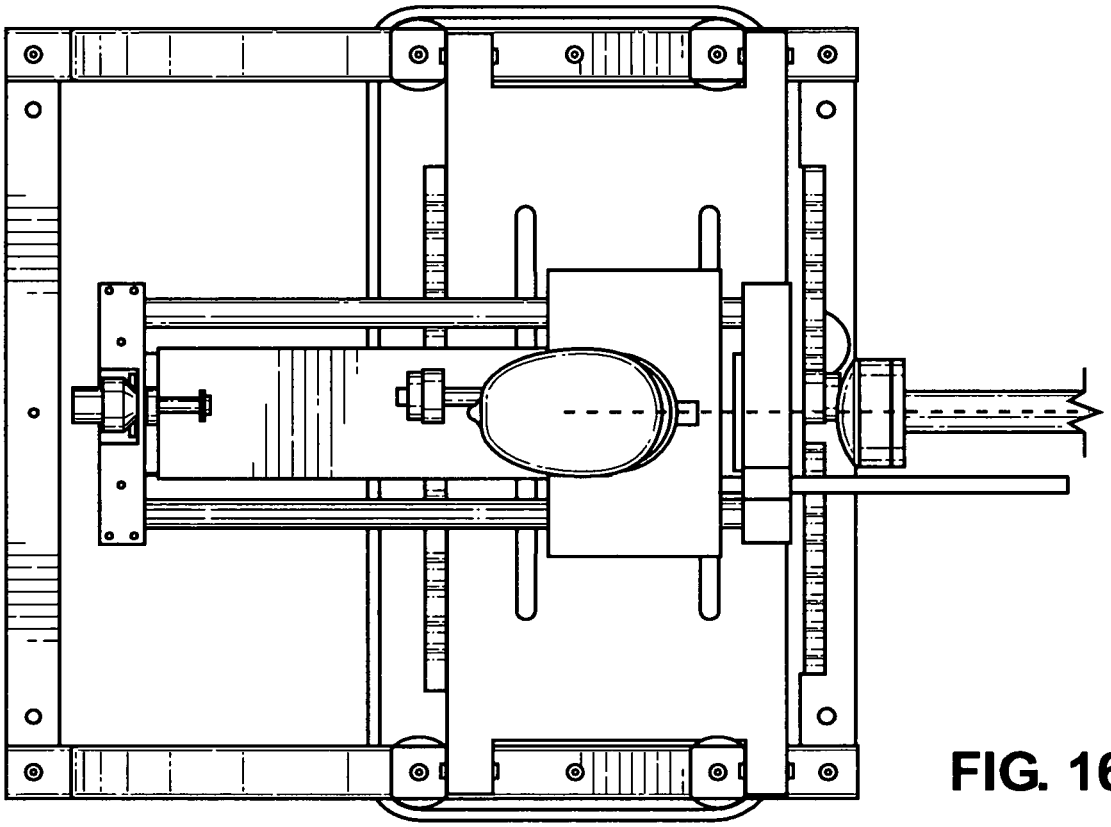
FIG. 16B is an overhead view showing the head position and orientation for impact site R.
Figure 17A:
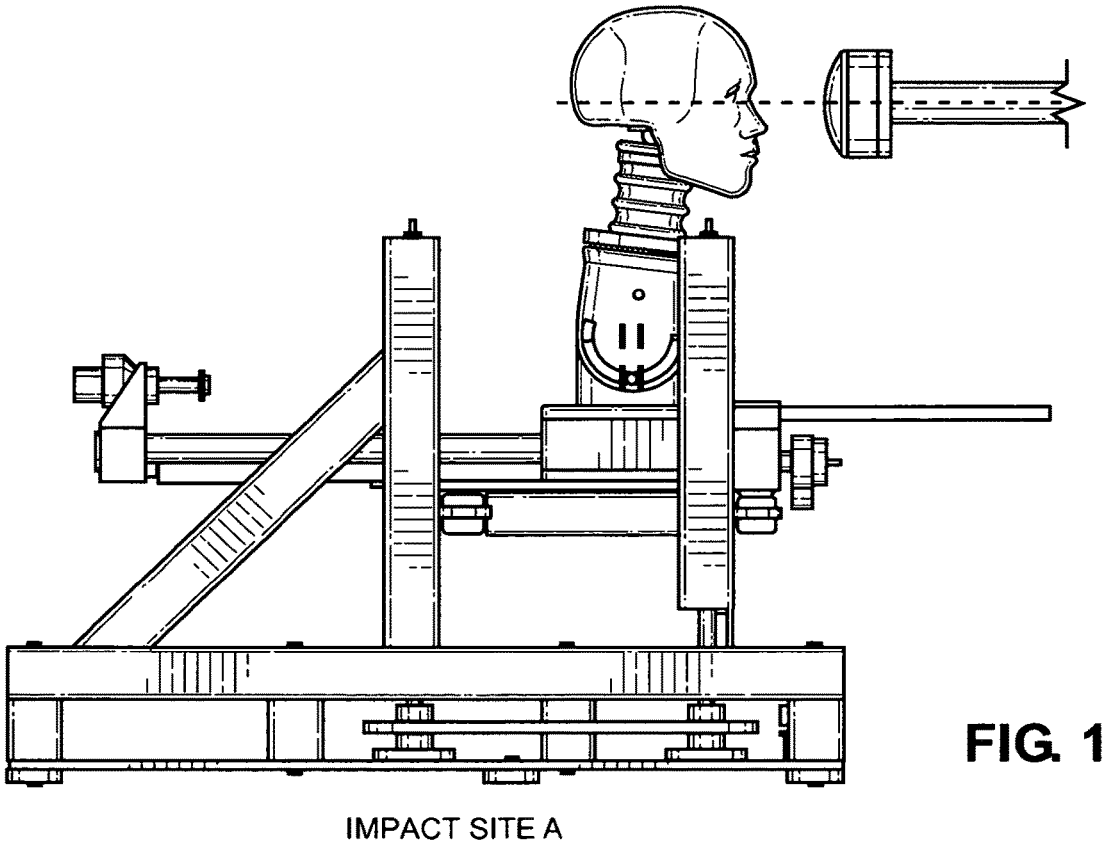
FIG. 17A is a side view showing the head position and orientation for impact site A.
Figure 17B:
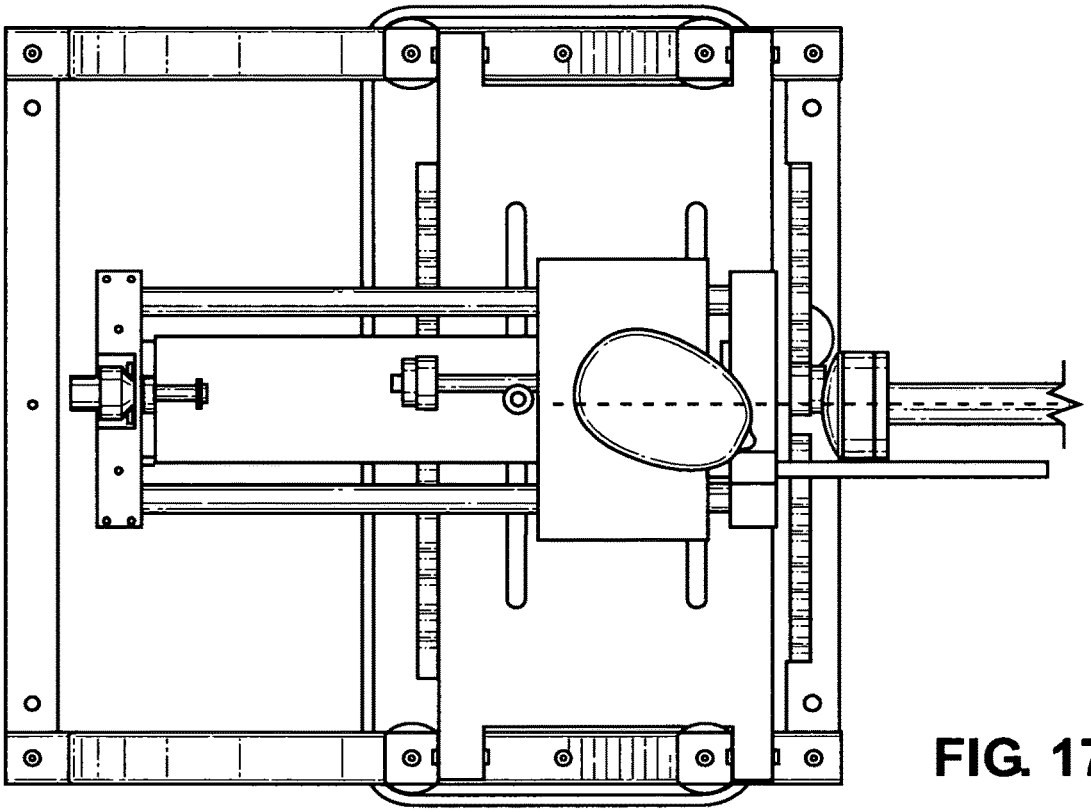
FIG. 17B is an overhead view showing the head position and orientation for impact site A.
Figure 18A:
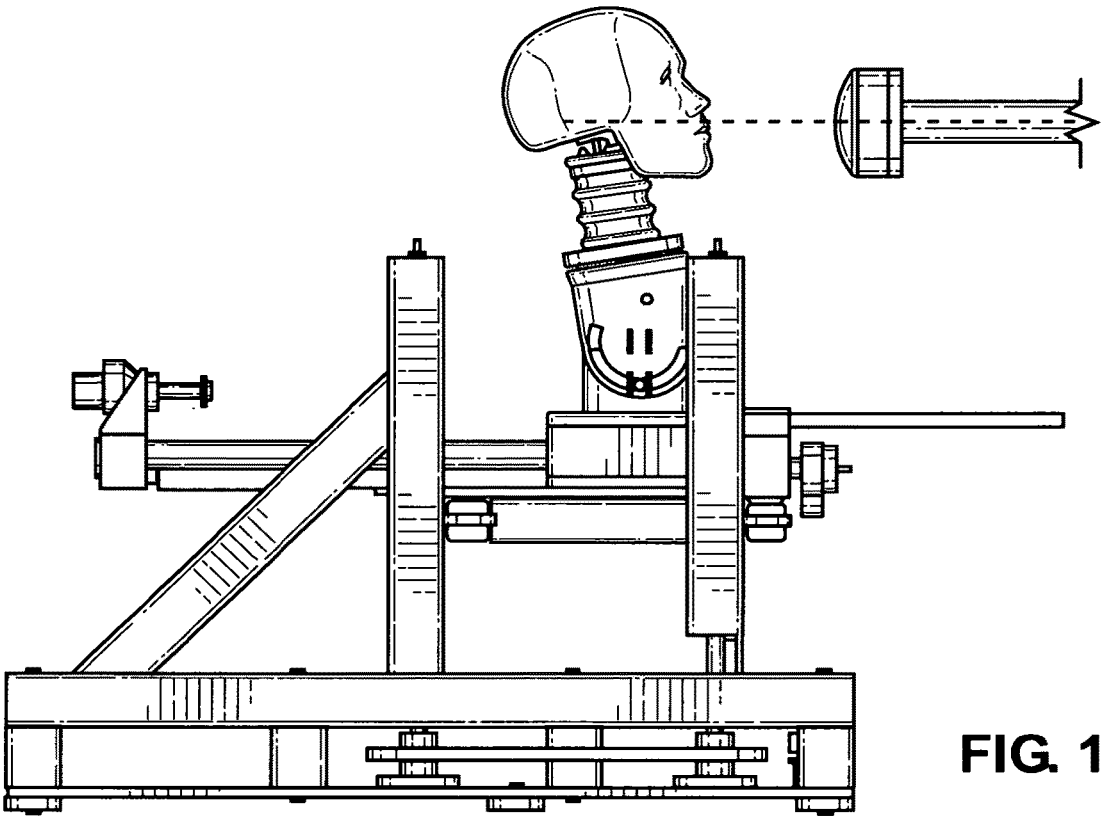
FIG. 18A is a side view showing the head position and orientation for impact site A.
Figure 18B:
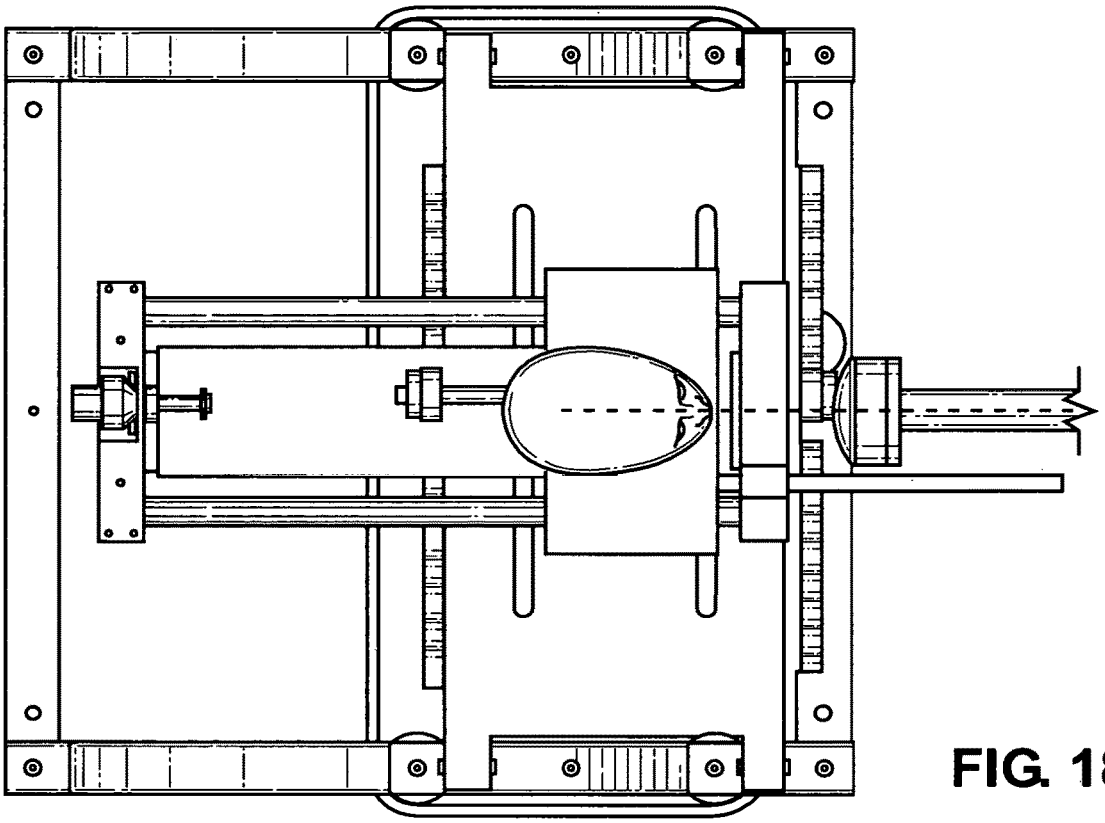
FIG. 18B is a top view showing the head position and orientation for impact site A.
Figure 19A:
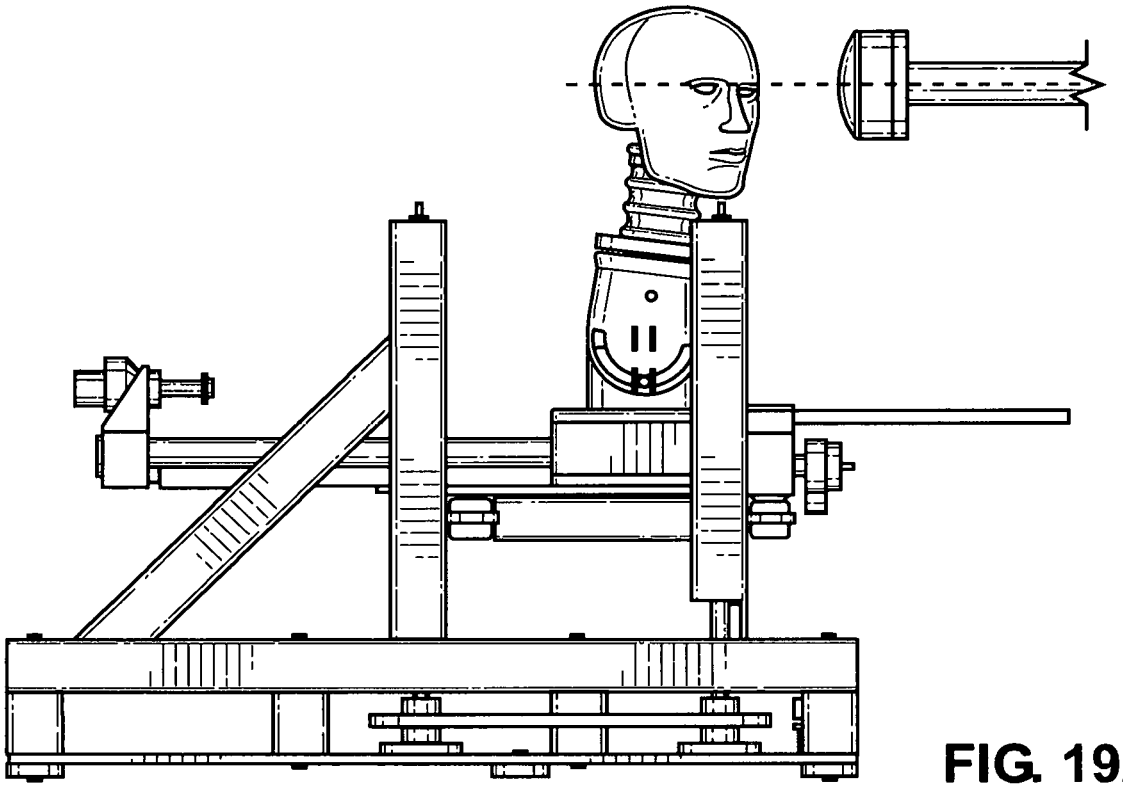
FIG. 19A is a side view showing the head position and orientation for impact site B.
Figure 19B:
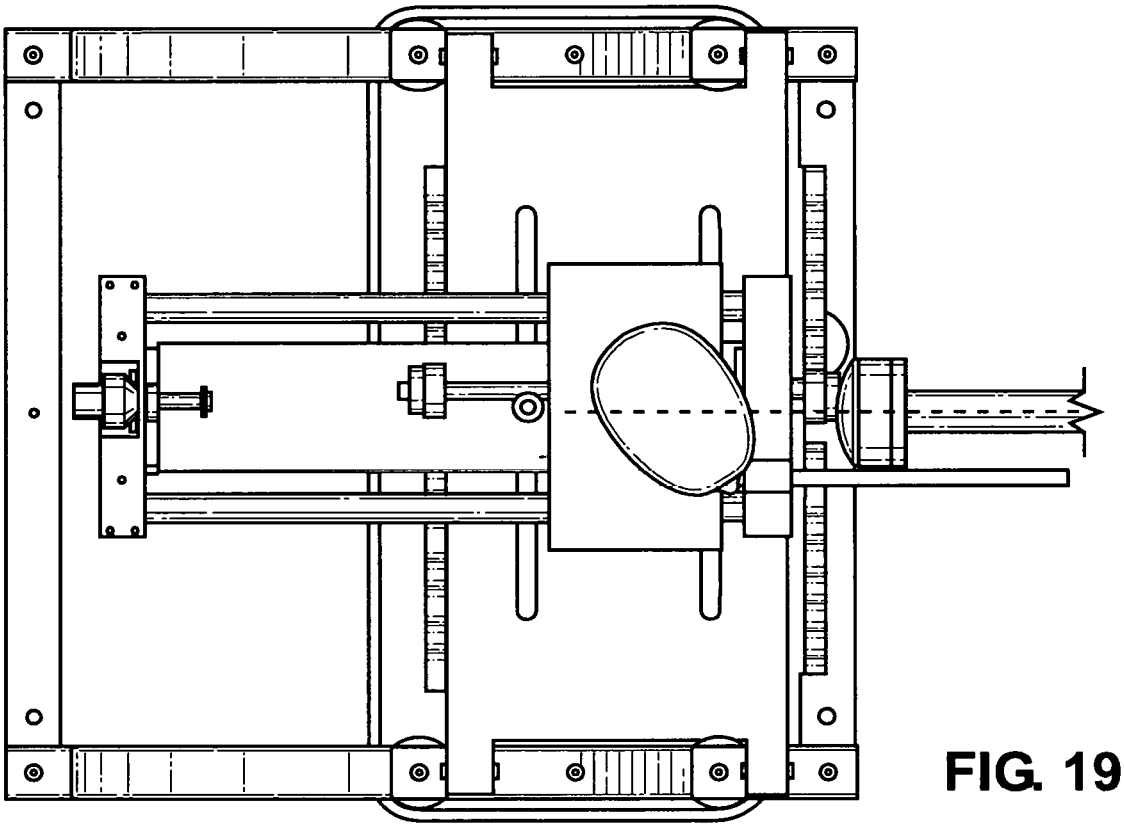
FIG. 19B is an overhead view showing the head position and orientation for impact site B.
Figure 20A:
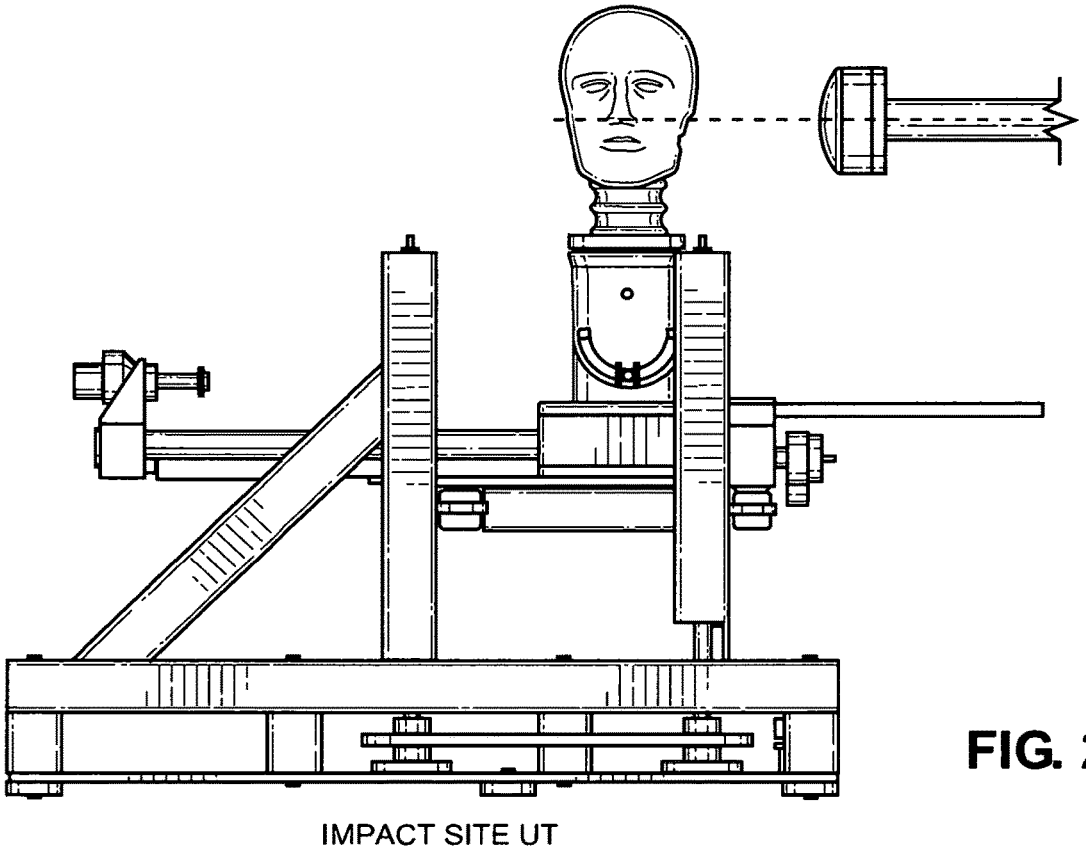
FIG. 20A is a side view showing the head position and orientation for impact site UT.
Figure 20B:
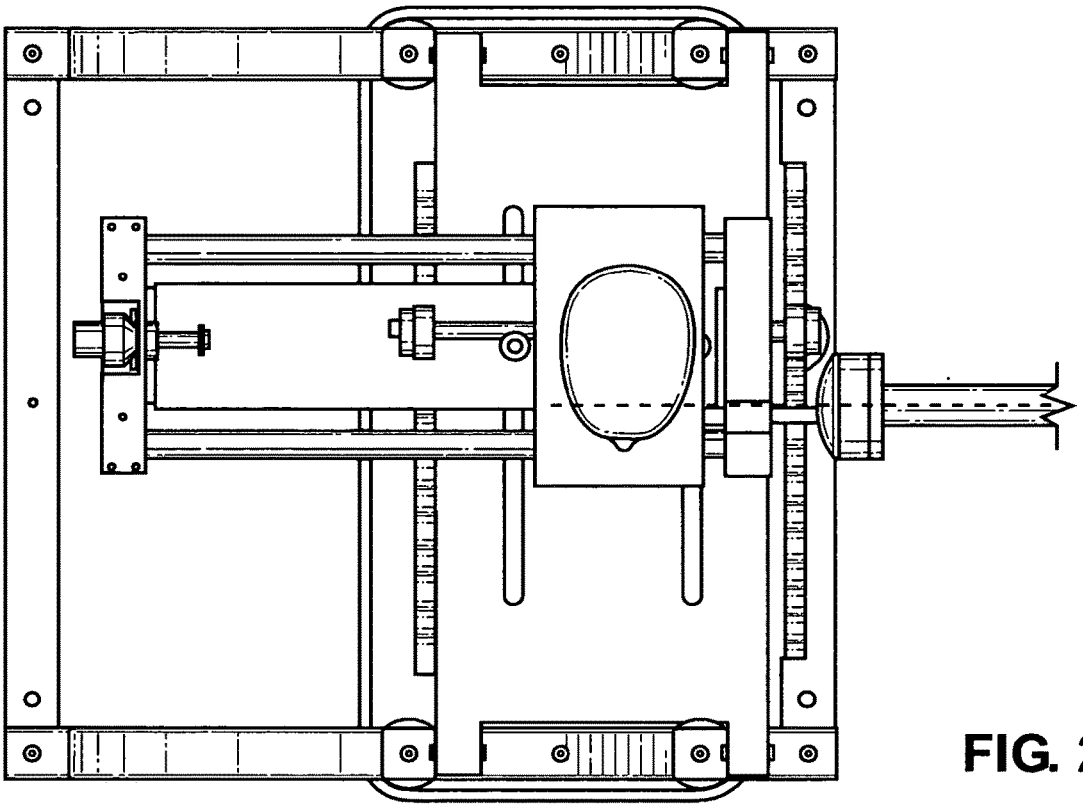
FIG. 20B is an overhead view showing the head position and orientation for impact site UT.

In yet another embodiment, there is a soft plastic outer layer 30 covering the semi-circular bumpers 17. This soft plastic outer layer 30, having a dur value of about 30 to about 50, will provide additional protection both for the wearer of the helmet and for any opposing player. In yet another embodiment, the soft plastic outer covering has the same appearance as the shell 2, and is unrippled on the outside surface 33 of the shell. There are a number of ways known in the art to attach the outer covering. In one embodiment, FIG. 12 shows one embodiment in which the plastic cover 30, only partially covering the bumpers 17, have hooks 40 which attach to the helmet between the hard shell 2 and the thick padding 3. In another embodiment, a hook and loop arrangement is used. In other embodiments, other means of attachment, including loops, can be used.

Testing

Several different impact sites on the helmet proposed by this disclosure and compared to football helmets currently being sold in the market place. The tests were performed by corner Chesapeake Testing, a NTS company, which is itself is an accredited independent helmet testing company. The actual tests performed correspond to the standards and tests agreed upon by the NFLPA (The NFL Players Association).

Three football helmets were tested, with two of the helmets being those taught in the disclosure. One of the proposed helmets tested has a bumper having a diameter of 1.5 inches, and the other proposed helmets has a diameter of 2" The other helmet is a commonly sold helmet.

There are four terms used in the charts.

The Severity Index (SI) is a threshold value for a general category of head injuries based on scientific research and published data. SI is a method for measuring a helmet's ability to reduce impact forces to the head, integrating acceleration over time. SI provides an accurate way to assess head injury risk that can be replicated across laboratories and under different impact scenarios. The NOCSAE standards are performance based and are design neutral so that manufacturers are not restricted in design or engineering, allowing innovation in design.

Linear Acceleration is the acceleration of the head in the direction of the impact. This is recorded in G's which is an acceleration value related to free-fall acceleration.

Average Acceleration is the maximum linear acceleration experienced at the center of gravity (center) of the head.

Figure 21A:
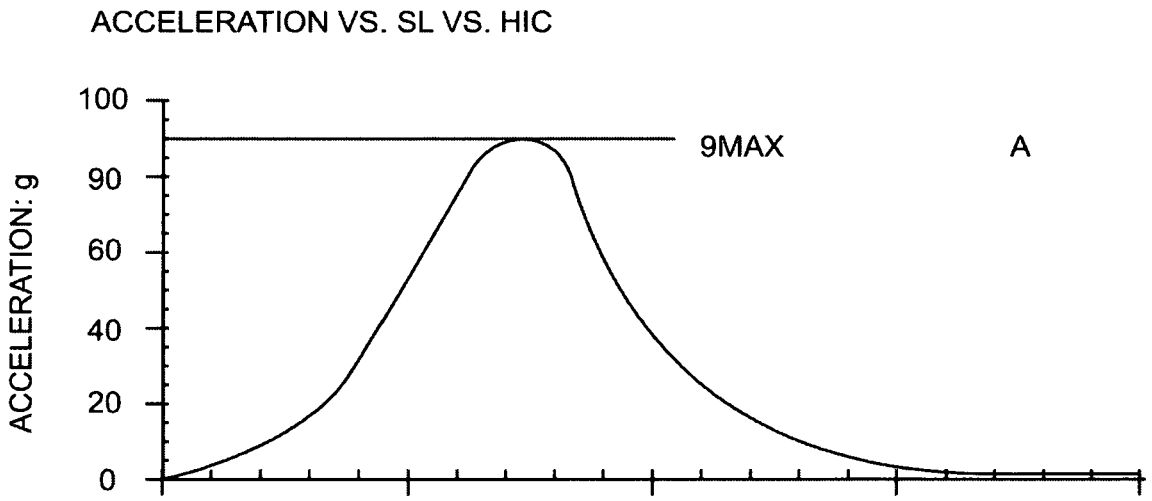
FIG. 21A-21C graphs the acceleration vs Serverity Index versus the HIC 15.
Figure 21B:
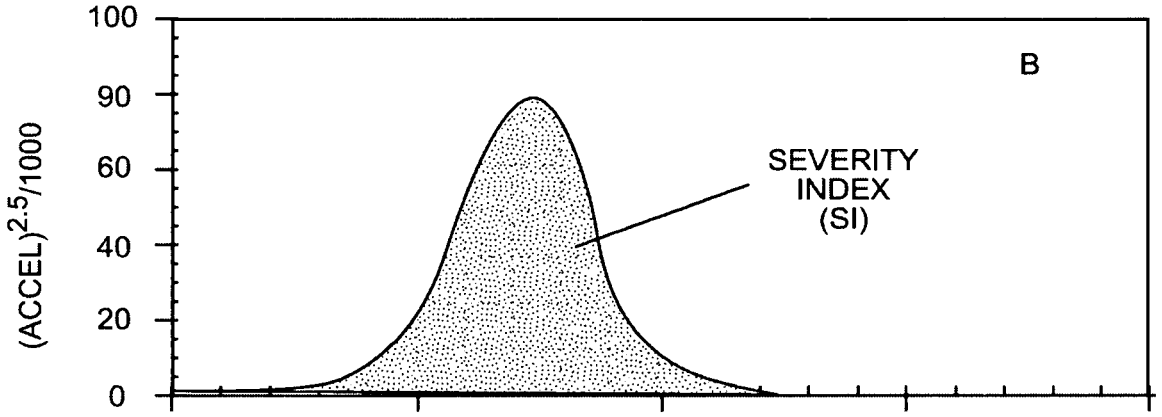
Figure 21C:
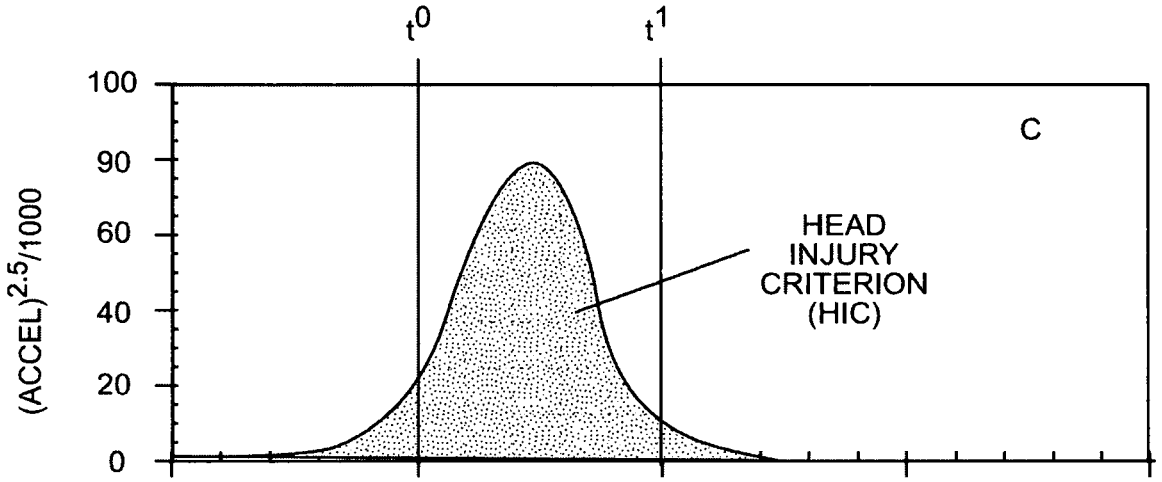

HIC 15 is a unit-less value that is closely related to SI, capturing the most aggressive 15-miliseconds of the impact event. The Acceleration vs. SI vs. HIC graph is shown in FIGS. 21A-21C. The ambient conditioned impacts testing results are found in FIG. 22, the Hot Conditioned Impact results are found in FIG. 23. FIGS. 24, 25, and 26 show the Linear Acceleration test results, the HIC15 test results, and the Severity Index test results. The codes in the Impact Site column correspond to the impact on the helmets shown in FIGS. 13 through 20. The Baker helmets correspond to the helmets in the disclosure and the tests are using the 1.5 and 2.0 inch bumpers for the Baker helmets.

As the charts show, the Baker helmets cushion is a great improvement over the standard football helmet, allowing better cushioning of blows from those one could expect in a football game. Such an improvement will greatly reduce head injuries when playing football.

It should be noted that the embodiments described herein can be used in combination with each other or with other embodiments. Additionally, the safety features described herein may be used with other helmets other than a football helmet. The safety features could be used in construction helmets, for example.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents.

The invention claimed is:

1. An energy diverting football helmet, said helmet comprising:

a) a shell, said shell having an inside and an outside;

b) a padding positioned up against the inside of the shell;

c) a plurality of flexible energy divergent baffles, said plurality of flexible energy divergent baffles capable of transferring energy angularly away from a point of impact, said plurality of flexible energy divergent baffles attached to the outside of said shell, each of said flexible energy divergent baffles having a height from 0.25 inch to more than one inch, each of said flexible energy divergent baffles comprising:

i) a rectangular base, said base having four sides, a bottom section of said base attached to said shell, and;

ii) a pyramidal shaped platform positioned on top of said base, said pyramidal shaped platform having four sides angled inwardly toward a center axis of the pyramidal shaped platform;

iii) a foot positioned on top of said pyramidal shaped platform, said foot comprising:

an angled post positioned on top of said pyramidal shaped platform, said angled post angled in stasis, said angled post comprising and being integral with a flat top, said angled post further comprising at least A) a first side angled away from the base; and B) a second side opposite said first side, said second side comprising a vertical rise on top of which is an angled side at an intersecting point of the vertical rise and the angled side;

said angled post being angled such that a center point of said flat top is horizontally offset from a center point of said base;

d) a plurality of wafers:

e) a plurality of bumpers, each of said wafers being attached to each of said bumpers and an underside of each of said wafers being attached to each said flat top of each said angled post.

2. The football helmet of claim 1, wherein each of said bumpers is comprised of rubber.

3. The football helmet of claim 1, wherein each of said flexible divergent baffles is comprised of rubber.

4. The football helmet of claim 2, wherein each of said flexible energy divergent baffles has a durometer hardness of no greater than 45 Shore A.

5. The football helmet of claim 4, wherein each of said flexible energy divergent baffles has a durometer hardness no greater than 35 Shore A.

6. The football helmet of claim 1, wherein each of said flexible energy divergent baffles is made of a material selected from the group consisting of rubber, plastic, and silicone.

7. The football helmet of claim 1, wherein each of said bumpers is comprised of a material selected from the group consisting of rubber, plastic, and silicone.

8. The football helmet of claim 1, wherein each of said bumpers has a durometer hardness of between about 70 to about 100 Shore A.

9. The football helmet of claim 1, further comprising a soft plastic layer covering each of said bumpers, said soft plastic layer having a durometer hardness of no greater than 50 Shore A.

10. The football helmet of claim 1, further comprising a face mask attached to a front of the football helmet.

11. The football helmet of claim 1, further comprising a chin strap.

12. An energy diverting football helmet, said helmet comprising:

a) a shell, said shell having an inside and an outside;

b) a padding positioned up against the inside of the shell;

c) a face mask attached to a front of the football helmet;

d) a plurality of flexible energy divergent baffles capable of transferring energy angularly away from a point of impact, said plurality of flexible energy divergent baffles attached to the outside of said shell, each of said flexible energy divergent baffles having a height from 0.25 inch to more than one inch, each of said flexible energy divergent baffles comprising:

i) a rectangular base, said base having four sides, a bottom section of said base attached to said shell, and;

ii) a pyramidal shaped platform positioned on top of said base, said pyramidal shaped platform having four sides angled toward a center axis of the pyramidal shaped platform;

iii) a foot positioned on top of said pyramidal shaped platform, said foot comprising:

an angled post positioned on top of said pyramidal shaped platform, said angled post angled in stasis, said angled post comprising and being integral with a flat top, said angled post further comprising at least:

A) a first side angled away from the base; and

B) a second side opposite said first side, said second side comprising a vertical rise on top of which is an angled side at an intersecting point of the vertical rise and the angled side;

said angled post being angled such that a center point of said flat top is horizontally offset from a center point of said base; and e) a plurality of bumpers, each of said bumpers being attached to each said flat top of each said angled post.

13. The football helmet of claim 12, wherein each of said bumpers is comprised of rubber.

14. The football helmet of claim 12, wherein each of said flexible energy divergent baffles is comprised of rubber.

15. The football helmet of claim 14, wherein each of said flexible energy divergent baffles has a durometer hardness of no greater than 45 Shore A.

16. The football helmet of claim 15, wherein each of said flexible energy divergent baffles has a durometer hardness no greater than 35 Shore A.

17. The football helmet of claim 16, wherein each of said flexible energy divergent baffles has a durometer hardness no greater than 30 Shore A.

18. The football helmet of claim 12, wherein each of said flexible energy divergent baffles is made of a material selected from the group consisting of rubber, plastic and silicone.

19. The football helmet of claim 12, wherein each of said bumpers is comprised of a material selected from the group consisting of rubber, plastic and silicone.

20. The football helmet of claim 12, wherein each of said bumpers has a durometer hardness of between about 70 to about 100 Shore A.

21. The football helmet of claim 19, further comprising a soft plastic layer covering each of said bumpers, said soft plastic layer having a durometer hardness of no greater than 50 Shore A.

22. The football helmet of claim 12 further comprising a chinstrap.

* * * * *